US011965298B2

(12) United States Patent
Al-Ghanim et al.

(10) Patent No.: US 11,965,298 B2
(45) Date of Patent: Apr. 23, 2024

(54) SYSTEM, APPARATUS, AND METHOD FOR DETECTING AND REMOVING ACCUMULATED SAND IN AN ENCLOSURE

(71) Applicant: Saudi Arabian Oil Company, Dhahran (SA)

(72) Inventors: Rami A. Al-Ghanim, Dhahran (SA); Abdullah Y. Al-Hassan, Dhahran (SA); Mazin A. Al-Khudhur, Dhahran (SA); Abdulaziz K. Al-Abdullatef, Khobar (SA); Nawwaf S. Al-Mutiri, Nariyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 399 days.

(21) Appl. No.: 17/457,171

(22) Filed: Dec. 1, 2021

(65) Prior Publication Data

US 2023/0167617 A1 Jun. 1, 2023

(51) Int. Cl.
*E01H 1/08* (2006.01)
*E01H 1/00* (2006.01)

(52) U.S. Cl.
CPC ... *E01H 1/0809* (2013.01); *E01H 2001/0881* (2013.01)

(58) Field of Classification Search
CPC . E01H 1/0809; E01H 2001/0881; E01H 1/00; E01H 1/0827
See application file for complete search history.

(56) References Cited

U.S. PATENT DOCUMENTS

| | | | |
|---|---|---|---|
| 4,240,287 | A | 12/1980 | Mast et al. |
| 5,259,245 | A | 11/1993 | Liu |
| 7,216,396 | B2 | 5/2007 | Slawinski |
| 9,891,626 | B2 | 2/2018 | Albaghajati et al. |
| 10,497,109 | B2 | 12/2019 | Fuchs |
| 10,918,252 | B2 | 2/2021 | Suvarna et al. |

(Continued)

FOREIGN PATENT DOCUMENTS

| | | | |
|---|---|---|---|
| CN | 106677607 | A | 5/2017 |
| CN | 211037354 | U * | 7/2020 |

(Continued)

OTHER PUBLICATIONS

Nozzles/Nozzle Arrays and Manifolds, Process Air Solutions, Sep. 21, 2021.

*Primary Examiner* — Marc Carlson
(74) *Attorney, Agent, or Firm* — Leason Ellis LLP

(57) ABSTRACT

A system for detecting and locating sand accumulation in an enclosure and for removing the detected and located sand accumulation, having a sand accumulation locator assembly adapted to detect and locate one or more accumulations of sand in the enclosure; a sand removal mechanism adapted to remove the detected one or more accumulations of sand; and a controller communicatively coupled to the sand accumulation locator assembly and the sand removal mechanism, said controller being adapted to: control the sand accumulation locator assembly to detect and locate the one or more accumulations of sand in the enclosure; and control the sand removal mechanism to remove the one or more detected accumulations of sand based on corresponding one or more locations of accumulated sand detected by the sand accumulation locator assembly.

20 Claims, 14 Drawing Sheets

(56) References Cited

U.S. PATENT DOCUMENTS

| | | | | |
|---|---|---|---|---|
| 10,946,878 | B1 * | 3/2021 | Beard | G08B 29/188 |
| 10,982,399 | B1 * | 4/2021 | Burks | E01F 15/06 |
| 11,027,317 | B2 | 6/2021 | Tibbetts et al. | |
| 11,072,752 | B1 * | 7/2021 | Ball, IV | C10G 73/30 |
| 2019/0133399 | A1 | 5/2019 | Morin et al. | |
| 2020/0125103 | A1 | 4/2020 | Li et al. | |
| 2020/0378815 | A1 | 12/2020 | Jiang et al. | |

FOREIGN PATENT DOCUMENTS

| | | | | |
|---|---|---|---|---|
| CN | 211037354 | U | | 7/2020 |
| CN | 111794530 | A | * | 10/2020 |
| CN | 111794530 | A | | 10/2020 |
| EP | 1482828 | B1 | | 9/2009 |
| FR | 2661700 | A1 | * | 11/1991 |

* cited by examiner

SYSTEM, APPARATUS, AND METHOD FOR DETECTING AND REMOVING ACCUMULATED SAND IN AN ENCLOSURE

FIELD OF THE DISCLOSURE

The present disclosure generally relates to site maintenance systems.

BACKGROUND OF THE DISCLOSURE

As computer and telecommunication networks continue to advance and expand, the distribution of information technology (IT) communication sites has increased to support the advancement and expansion of such networks. These IT communication sites provide communication means (network, radio, telephony, transmission, VSAT, . . . etc.) and, for private networks, are classified as restricted areas. For securing such sites as restricted areas where only authorized personnel allowed access, security measures, such as fencing, are implemented to prevent any unauthorized access. Many of these IT communication sites can be relay stations that operate autonomously a substantial portion of the time. As such, physical access to these sites might not be required for extended periods of time. Conversely, access to these sites can frequently be necessitated by emergencies, such as equipment malfunction, at the sites. Therefore, while access to the sites may be infrequent, it still needs to be readily available for emergencies.

The present disclosure addresses the issue of sand accumulation at secure IT communication sites that are distributed across desert regions for supporting networks established in such regions. FIG. 1 is an illustration of a communication site 100 to which the present disclosure applies. As shown in FIG. 1, communication site 100 includes communication structure (such as a communication tower and the like) 105, fencing 110, gate 115, and building 120. As noted above, IT communication sites, such as site 100, can be unattended for extended periods of time. Consequently, a substantial amount of sand can accumulate at these IT communication sites between accesses to these sites, especially in regions that are susceptible to frequent sandstorms.

Sand accumulation in and around these sites can present numerous problems. For example, sand accumulation can occur at or outside of fencing 110 near gate 115, as illustrated by reference numeral 1115, which would block gate 115 of fence 110 and disrupt timely access to site 100. Correspondingly, sand accumulation at an entrance to building 120—for example, at 1120—can, likewise, disrupt access to key equipment during emergencies. This can cause undue delays and affect service response times to emergencies. Additionally, sand accumulation—for example, at 1105—on outdoor equipment, such as communication structure 105, can affect performance of the equipment. Additional examples of outdoor equipment that can be affected by sand accumulation include electrical transformers (not shown) that feed power to communication site 100, Air Handling Units (AHUs) (not shown) that provide cooling to building 120, and outdoor fuel tanks (not shown) for power generators, the power generators themselves (not shown), to name a few. The proper functioning of the equipment is essential to communication site 100 and the equipment needs to be readily accessible to perform any routine activities. When sand accumulates in and around site 100, it jeopardizes the critical operations of the equipment and can pose a safety risk. Furthermore, the physical security of communication site 100 can be rendered vulnerable because sand accumulating at fence 110 to an extreme high level—for example, at 1110—can add the risk of unauthorized personnel breaching site 100.

The conventional method for the removal of sand accumulation is through hiring a third party with specialized equipment that relocates the accumulated sand inside the fenced area of site 100 to the outside of fencing 110. The third party would be scheduled to perform the removal once to twice a year, or quarterly, based on the condition and location of the site. This method is extremely costly, does not ensure the cleanliness of the site at all times, and requires tremendous efforts in manpower to perform the periodic sand removals.

SUMMARY OF THE DISCLOSURE

In view of the above-noted problems with sand accumulation at remote communication sites in desert regions, it is an objective of the present disclosure to provide a low cost and efficient system for reducing sand accumulation at these remote communication sites.

According to an exemplary embodiment of the present disclosure, a system for detecting and locating sand accumulation in an enclosure and for removing the detected and located sand accumulation, comprises: a sand accumulation locator assembly adapted to detect and locate one or more accumulations of sand in the enclosure; a sand removal mechanism adapted to remove the detected one or more accumulations of sand; and a controller communicatively coupled to the sand accumulation locator assembly and the sand removal mechanism, said controller being adapted to: control the sand accumulation locator assembly to detect and locate the one or more accumulations of sand in the enclosure; and control the sand removal mechanism to remove the one or more detected accumulations of sand based on corresponding one or more locations of accumulated sand detected by the sand accumulation locator assembly.

According to an exemplary embodiment, a system for detecting and locating sand accumulation in an enclosure and for removing the detected and located sand accumulation, comprises: a sand accumulation locator assembly adapted to detect and locate one or more accumulations of sand in the enclosure; a sand removal mechanism adapted to remove the detected one or more accumulations of sand; a controller communicatively coupled to the sand accumulation locator assembly and the sand removal mechanism, said controller being adapted to: control the sand accumulation locator assembly to detect and locate the one or more accumulations of sand in the enclosure; and control the sand removal mechanism to remove the one or more detected accumulations of sand based on corresponding one or more locations of accumulated sand detected by the sand accumulation locator assembly; and a monitoring apparatus communicatively coupled to the controller and adapted to monitor performances of the sand accumulation locator assembly and the sand removal mechanism, the monitoring apparatus comprising an alert indicator for issuing an alert to an operator upon detecting a malfunction or failure.

According to an embodiment, the sand accumulation locator assembly comprises a mobile sand detection mechanism adapted to traverse a path in the enclosure, said mobile sand detection mechanism comprising a detector adapted to detect a sand accumulation at a position on the path of the mobile sand detection mechanism.

According to an embodiment, the detector comprises a resistance detecting member that traverses the path along a track disposed proximate a substantially horizontal surface in the enclosure, the resistance detecting member extending towards the substantially horizontal surface while traversing the path and detecting the sand accumulation upon detecting a resistance on an outer surface of the resistance detecting member while traversing the path.

According to an embodiment, the track is disposed along a bottom portion of fencing around the enclosure.

According to an embodiment, the sand removal mechanism comprises a plurality of air nozzles disposed along the path of the mobile sand detection mechanism, and the controller is further adapted to toggle at least a subset of the plurality of air nozzles corresponding to the position of the mobile sand detection mechanism upon the mobile sand detection mechanism detecting the sand accumulation.

According to an embodiment, the mobile sand detection mechanism comprises a vehicle having a vacuum pump, a container, and a container content weight detector, the vehicle being controlled by the controller to traverse the path according to algorithmic programming.

According to an embodiment, the container content weight detector detects the sand accumulation upon detecting a weight increase in connection with the container of the vehicle.

According to an embodiment, the controller is further adapted to control the vehicle to interrupt the path and to remove the detected sand accumulation using the vacuum pump and the container of the vehicle at the position on the path of the mobile sand detection mechanism.

According to an embodiment, the controller is further adapted to control the vehicle to empty the container at a peripheral location of the enclosure upon the container content weight detector detecting that the weight increase exceeds a container threshold.

According to an embodiment, the controller is further adapted to control the vehicle to return to the position on the path of the mobile sand detection mechanism corresponding to the detected sand accumulation after emptying the container at the peripheral location.

According to an embodiment, the sand accumulation locator assembly comprises: one or more surface condition detectors disposed at respective one or more locations proximate a substantially horizontal surface in the enclosure; and one or more elevated position condition detectors disposed at respective one or more elevated positions in correspondence with the plurality of surface condition detectors, and the controller is further adapted to: interpret outputs from the one or more surface condition detectors based at least in part upon an output from the one or more elevated position condition detectors to determine the one or more locations of accumulated sand; and control the sand removal mechanism to remove the accumulated sand at the one or more determined locations.

According to an embodiment, the one or more surface condition detectors are disposed along a bottom portion of fencing around the enclosure, and the one or more elevated position condition detectors are disposed at respective one or more locations on a top portion of the fencing around the enclosure.

According to an embodiment, the sand removal mechanism comprises a plurality of air nozzles disposed proximate locations associated with the one or more surface condition detectors, and the controller is further adapted to toggle at least a subset of the plurality of air nozzles corresponding to the one or more determined locations of accumulated sand.

According to an embodiment, the one or more surface condition detectors comprise a plurality of surface temperature detectors, the one or more elevated position condition detectors comprise one or more elevated position temperature detectors, and the controller adapted to interpret the outputs of the one or more surface condition detectors is further adapted to: compare surface temperatures detected at the plurality of surface temperature detectors with an elevated position temperature detected at the one or more elevated temperature detectors; and determine the one or more locations of accumulated sand by locating one or more of the—surface temperature detectors corresponding to detected surface temperatures that exceed the elevated position temperature by more than a predetermined temperature difference threshold.

According to an embodiment, the one or more surface condition detectors comprise one or more surface object distance detectors, the one or more elevated position condition detectors comprise one or more anemometers, and the controller adapted to interpret the outputs of the one or more surface condition detectors is further adapted to: determine a wind speed based on an output from the one or more anemometers; when the determined wind speed is below a first threshold, toggle the one or more surface object distance detectors at a first frequency; when the determined wind speed exceeds the first threshold, toggle the one or more surface object distance detectors at a second frequency higher than the first frequency until the determined wind speed is below a second threshold; and determine the one or more locations of accumulated sand based on detected distances of the toggled one or more surface object distance detectors.

According to an embodiment, the sand removal mechanism comprises an array of air nozzles disposed proximate respective locations corresponding to detectable distances of the one or more surface object distance detectors, and the controller is further adapted to toggles at least a subset of the array of air nozzles corresponding to the determined one or more locations of accumulated sand.

According to an embodiment, the first frequency is below once per day.

According to an embodiment, the second frequency exceeds once per day.

According to an embodiment, the first threshold is approximately 25 miles per hour (mph).

According to an embodiment, the second threshold is approximately 15.5 miles per hour (mph).

Advantageously, the system and techniques for detecting and removing sand accumulation of the present disclosure provides considerable cost savings as the need for a third party to perform the sand removal is eliminated.

The system of the present disclosure provides an innovative and efficient mechanism for sand removal at sites in differing regions with different levels of sand accumulation. The regular and frequent cleaning for the sites provided by the system of the present disclosure prevents higher sand accumulation and the formation of sand dunes. The system of the present disclosure further provides the following advantages:

a. optimize resources and manpower, which contributes to additional cost savings;
b. facilitate timely routine operations and maintenance;
c. ensure site readiness and enhance response times especially during emergencies; and
d. provide a monitoring tool and a control system for remote sites, and provide an alert system to enhance an operator's decision making.

BRIEF DESCRIPTION OF THE DRAWINGS

Various exemplary embodiments of this disclosure will be described in detail, with reference to the following figures, wherein.

DETAILED DESCRIPTION OF CERTAIN EMBODIMENTS CONSISTENT WITH THE DISCLOSURE

The following exemplary embodiment is described based on sand accumulation detection, location, and removal features, which can be incorporated into other types of site cleaning systems without departing from the spirit and the scope of the disclosure.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must).

Figure 1:
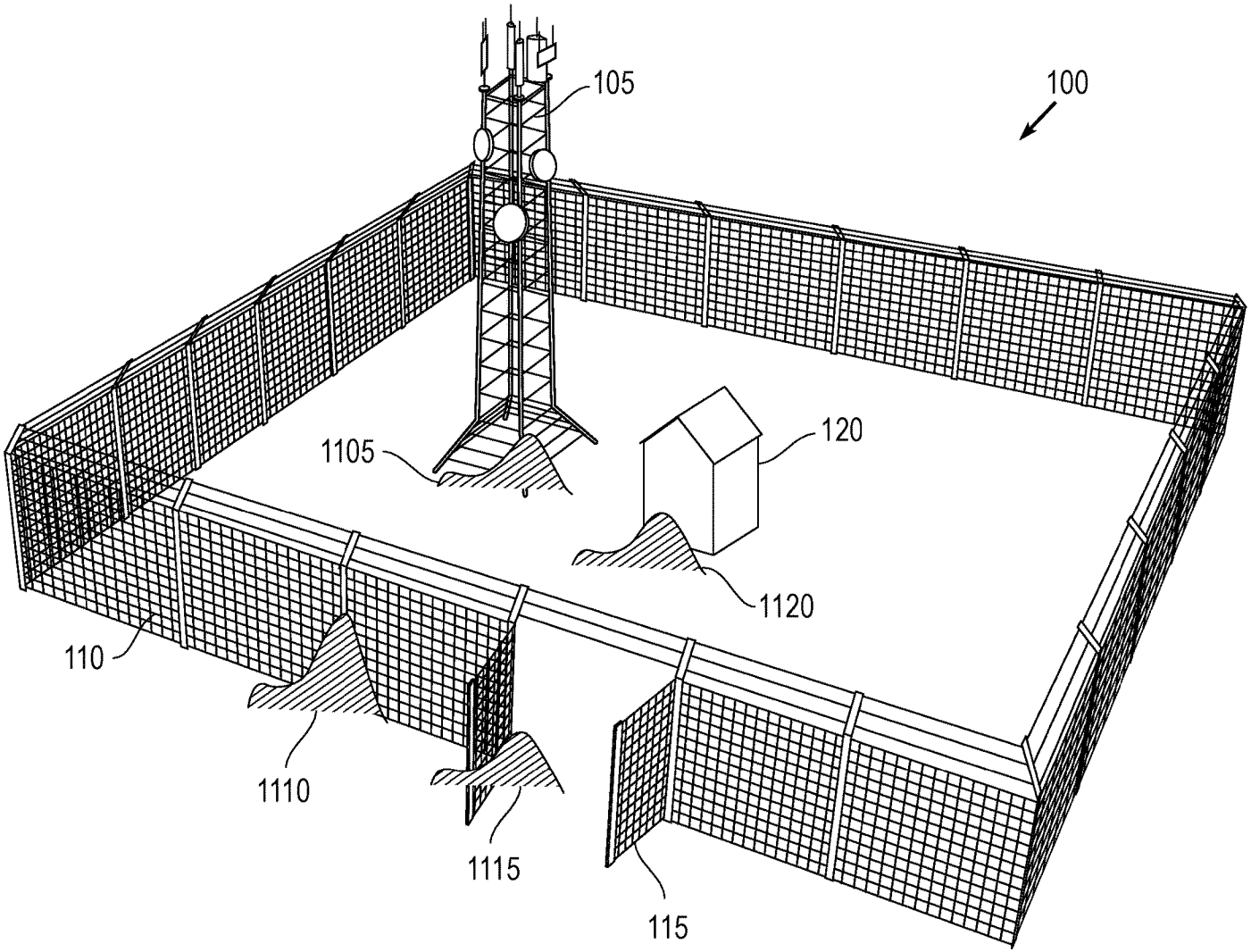
FIG. 1 is an illustration of a communication site 100 to which the present disclosure applies.
Figure 2:
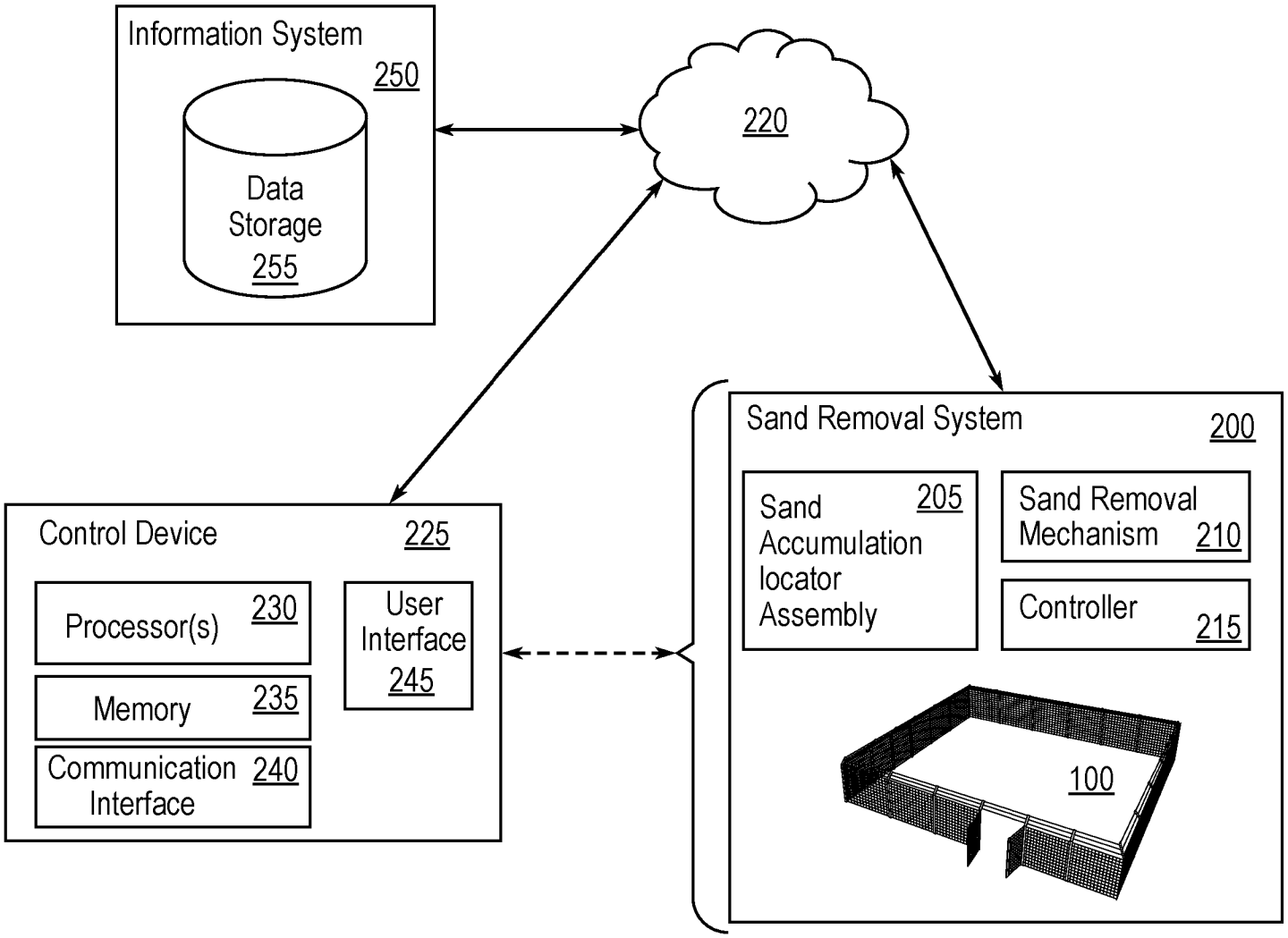
FIG. 2 is a schematic diagram illustrating an exemplary embodiment of a system for detecting, locating, and removing sand accumulations in an enclosure according to the present disclosure.

FIG. 2 is a schematic diagram illustrating an exemplary embodiment of a system 200 for detecting, locating, and removing sand accumulations in an enclosure, such as site 100 enclosed by fencing 110 illustrated in FIG. 1. FIG. 2 illustrates site 100 as the enclosure to which system 200 is applied but system 200 is equally applicable to any indoor or outdoor enclosures with a perimeter defined by an enclosing element, such as a fence, a wall, and the like.

According to an exemplary embodiment, sand removal system 200 includes a sand accumulation locator assembly 205 that is adapted to detect and locate sand accumulations in and around site 100. Correspondingly, system 200 incorporates a sand removal mechanism 210 that is adapted to remove the sand accumulations located by the sand accumulation locator assembly 205. Assembly 205 and mechanism 210 are controlled by a controller 215, which can be embodied by one or more processing devices operating according to software instructions stored in a memory (not shown) associated with controller 215. According to an exemplary embodiment, the features of controller 215 can be performed by one or more hardware logic components including, but not limited to, field-programmable gate arrays ("FPGA"), application specific integrated circuits ("ASICs"), application-specific standard products ("ASSPs"), system-on-chip systems ("SOCs"), and/or complex programmable logic devices ("CPLDs"). Furthermore, controller 215 can include its own local memory, which can store program systems, program data, and/or one or more operating systems.

As illustrated in FIG. 2, system 200 is communicatively connected to a network 220. The network connection can be through a network interface (not shown) coupled to controller 215. According to an exemplary embodiment, controller 215 is in communication with a control device 225 adapted to provide programming and control interfaces to an operator for system 200. In embodiments, controller 215 can be embodied by control device 225 to provide a local and direct control interface to system 200 for an operator. In embodiments, control device 225 can be in communication with controller 215 and system 200 from a remote location via network 220 for remote monitoring, controlling, and programming of system 200.

Communications systems for facilitating network 220 can include hardware (e.g., hardware for wired and/or wireless connections) and/or software. In embodiments, communications systems can include one or more communications chipsets, such as a GSM chipset, CDMA chipset, LTE chipset, 4G/5G/6G, Wi-Fi chipset, Bluetooth chipset, to name a few, and/or combinations thereof. Wired connections can be adapted for use with cable, plain old telephone service (POTS) (telephone), fiber (such as Hybrid Fiber Coaxial), xDSL, to name a few, and wired connections can use coaxial cable, fiber, copper wire (such as twisted pair copper wire), and/or combinations thereof, to name a few. Wired connections can be provided through telephone ports, Ethernet ports, USB ports, and/or other data ports, such as Apple 30-pin connector ports or Apple Lightning connector ports, to name a few. Wireless connections can include cellular or cellular data connections and protocols (e.g., digital cellular, PCS, CDPD, GPRS, EDGE, CDMA2000, 1×RTT, RFC 1149, Ev-DO, HSPA, UMTS, 3G, 4G, LTE, 5G, and/or 6G to name a few), Bluetooth, Bluetooth Low Energy, Wi-Fi, radio, satellite, infrared connections, ZigBee communication protocols, to name a few. Communications interface hardware and/or software, which can be used to communicate over wired and/or wireless connections, can include Ethernet interfaces (e.g., supporting a TCP/IP stack), X.25 interfaces, T1 interfaces, and/or antennas, to name a few. Computer systems—such as controller 215, control device 220, and information system 250—can communicate with other computer systems or devices directly and/or indirectly, e.g., through a data network, a telephone network, a mobile broadband network (such as a cellular data network), a mesh network, Wi-Fi, WAP, LAN, and/or WAN, to name a few.

Control device 225 can be any computing device and/or data processing apparatus capable of embodying the systems and/or methods described herein and can include, for each corresponding operator for system 200, any suitable type of electronic device including, but are not limited to, workstations, desktop computers, mobile computers (e.g., laptops, ultrabooks), mobile phones, portable computing devices, such as smart phones, tablets, personal display devices, personal digital assistants ("PDAs"), virtual reality devices, wearable devices (e.g., watches), to name a few, with network access that is uniquely identifiable by Internet Protocol (IP) addresses and Media Access Control (MAC) identifiers.

One or more processor(s) 230 can include any suitable processing circuitry capable of controlling operations and functionality of control device 225, as well as facilitating communications between various components within control device 225. In some embodiments, processor(s) 230 can include a central processing unit ("CPU"), a graphic processing unit ("GPU"), one or more microprocessors, a digital signal processor, or any other type of processor, or any combination thereof. In embodiments, processor(s) 230 can be implemented in accordance with the exemplary implementations for controller 215 described above, which will not be repeated here.

Memory 235 can include one or more types of storage mediums, such as any volatile or non-volatile memory, or any removable or non-removable memory implemented in any suitable manner to store data for control device 225. For example, information can be stored using computer-readable instructions, data structures, and/or program systems. Various types of storage/memory can include, but are not limited to, hard drives, solid state drives, flash memory, permanent memory (e.g., ROM), electronically erasable programmable read-only memory ("EEPROM"), CD ROM, digital versatile disk ("DVD") or other optical storage medium, magnetic cassettes, magnetic tape, magnetic disk storage or other magnetic storage devices, RAID storage systems, or any other storage type, or any combination thereof. Furthermore, memory 235 can be implemented as computer-readable storage media ("CRSM"), which can be any available physical media accessible by processor(s) 230 to execute one or more instructions stored within memory 235. According to an exemplary embodiment, one or more applications corresponding to the sand accumulation location, removal, and system monitoring features described in further detail below are stored in memory 235 and executed by processor(s) 230.

Communication interface 240 can include any circuitry allowing or enabling one or more components of control device 225 to communicate with one or more additional devices, servers, and/or systems—for example, one or more of system 200 (including sand accumulation locator assembly 205, sand removal mechanism 210, and/or controller 215) and information system 250. As an illustrative example, data recorded by receivers 105-1 . . . **105-*n* can be transmitted over network 220 to seismic data processing apparatus 301 using any number of communications protocols either directly or through control device 350. For example, network(s) 220 can be accessed using Transfer Control Protocol and Internet Protocol ("TCP/IP") (e.g., any of the protocols used in each of the TCP/IP layers), Hypertext Transfer Protocol ("HTTP"), WebRTC, SIP, and wireless application protocol ("WAP"), are some of the various types of protocols that can be used to facilitate communications between system 200 and control device 225. Various additional communication protocols can be used to facilitate communications between system 200 and control device 225**, include the following non-exhaustive list, Wi-Fi (e.g., 802.11 protocol), Bluetooth, radio frequency systems (e.g., 900 MHz, 1.4 GHz, and 5.6 GHz communication systems), cellular networks, FTP, RTP, RTSP, SSH, to name a few.

User interface 245 is operatively connected to processor(s) 230 and can include one or more input or output device(s), such as switch(es), button(s), key(s), a touch screen, a display, microphone, camera(s), sensor(s), etc. as would be understood in the art of electronic computing devices.

Information system 250 incorporates data storage 255 that embodies storage media for storing data from sand removal system 200 (including monitoring results thereof described in further detail below) and control device 225 (including operation history, control parameters, monitoring results, weather information, location information, etc., related to sand removal system 200). Exemplary storage media for data storage 255 correspond to those described above with respect to memory 235, which will not be repeated here. In embodiments, information system 250 incorporates one or more database servers that support Oracle SQL, NoSQL, NewSQL, PostgreSQL, MySQL, Microsoft SQL Server, Sybase ASE, SAP HANA, DB2, and the like. Information system 250 incorporates a communication interface (not shown) for communications with the aforementioned entities—i.e., sand removal system 200 and control device 225—and exemplary implements of which can include those described above with respect to communication interface 240 which will not be repeated here.

Figure 3A:
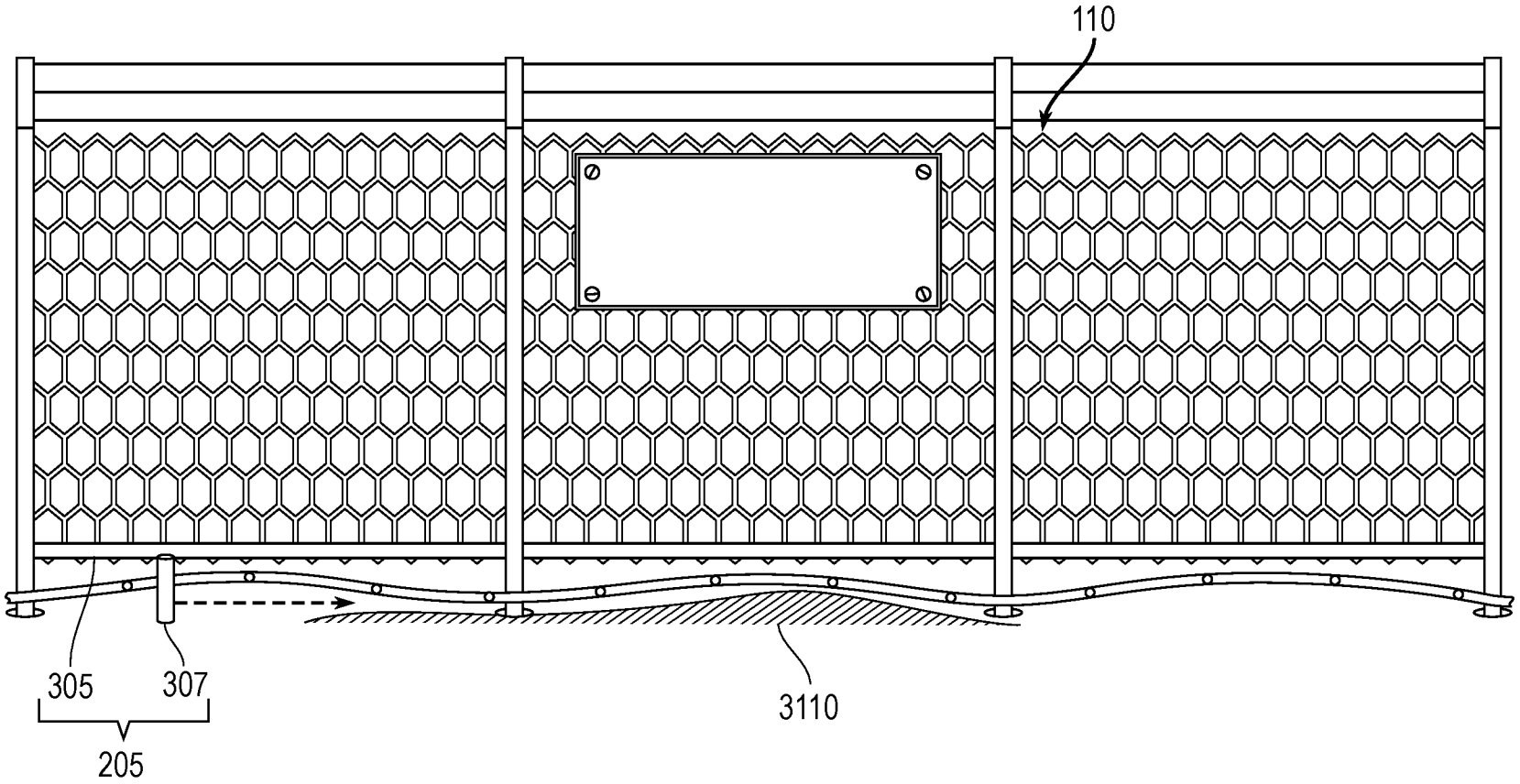
FIGS. 3A, 3B, 3C, and 3D are graphical illustrations of an operation for an exemplary implementation of a sand accumulation locator assembly, which incorporates a mobile sand detection mechanism, and a sand removal mechanism according to the present disclosure.

FIGS. 3A, 3B, 3C, and 3D are graphical illustrations of an operation for an exemplary implementation of sand accumulation locator assembly 205 and sand removal mechanism 210 for detecting and removing a sand accumulation 3110 at fencing 110 according to the present disclosure. As illustrated in FIG. 3A, sand accumulation locator assembly 205 includes a track 305 that is disposed along a bottom portion of fencing 110 around site 100 (see also FIG. 1 for an illustration of fencing 110 around a perimeter of site 100). Track 305 provides a route (or path) along which a resistance sensor 307 can travel around the perimeter of site 100. Thus, resistance sensor 307 embodies a mobile sand detection mechanism adapted to traverse a path defined by track 305 in an enclosure formed by fencing 110. According to an exemplary embodiment, multiple resistance sensors (not shown) can be deployed, where each sensor travels back and forth along a straight track 305 disposed along a bottom portion of each straight section of fencing 110. As an example, four (4) resistance sensors (307) can be deployed for site 100 shown in FIG. 1, with one sensor traveling along each straight section of a track (305) (not shown in FIG. 1) disposed along a bottom portion of each of the four (4) straight sections of fencing 110 that define the rectangular perimeter of site 100 shown in FIG. 1. In embodiments, curved track sections can be deployed to accommodate irregular site perimeters and/or sections. In embodiments, curved track sections can also be incorporated to form a complete track loop for one or more resistance sensors (307) to travel around the perimeter of an enclosed site in one direction. FIGS. 3A-3D illustrate track 305 and sensor 307 being disposed on an exterior of fencing 110—i.e., exterior to site 100 shown in FIG. 1—but track 305 and sensor 307 can also be disposed on an interior of fencing 110 in relation to site 100 shown in FIG. 1.

Referring back to FIG. 3A, resistance sensor 307 moves along track 305, as indicated by the rightward dashed arrow. In accordance with an exemplary embodiment, track 305 is a magnetic track and resistance sensor 307 is actuated to move by a linear motor. In embodiments, alternative means, such as wheeled mechanisms, pulley mechanisms, and the like, can be used to move sensor 307 along track 305 disposed at the bottom portion of fencing 110.

According to an exemplary embodiment, sensor 307 has an elongate shape that is directed generally towards the ground surface, which is a substantially horizontal surface, below fencing 110 as it travels along track 305. The elongate shape of sensor 307 is coupled to a force sensor, such as a load cell, strain gauge, and the like, (not shown) for detecting any resistance force exerted on the outer surface of sensor 307.

Figure 3B:
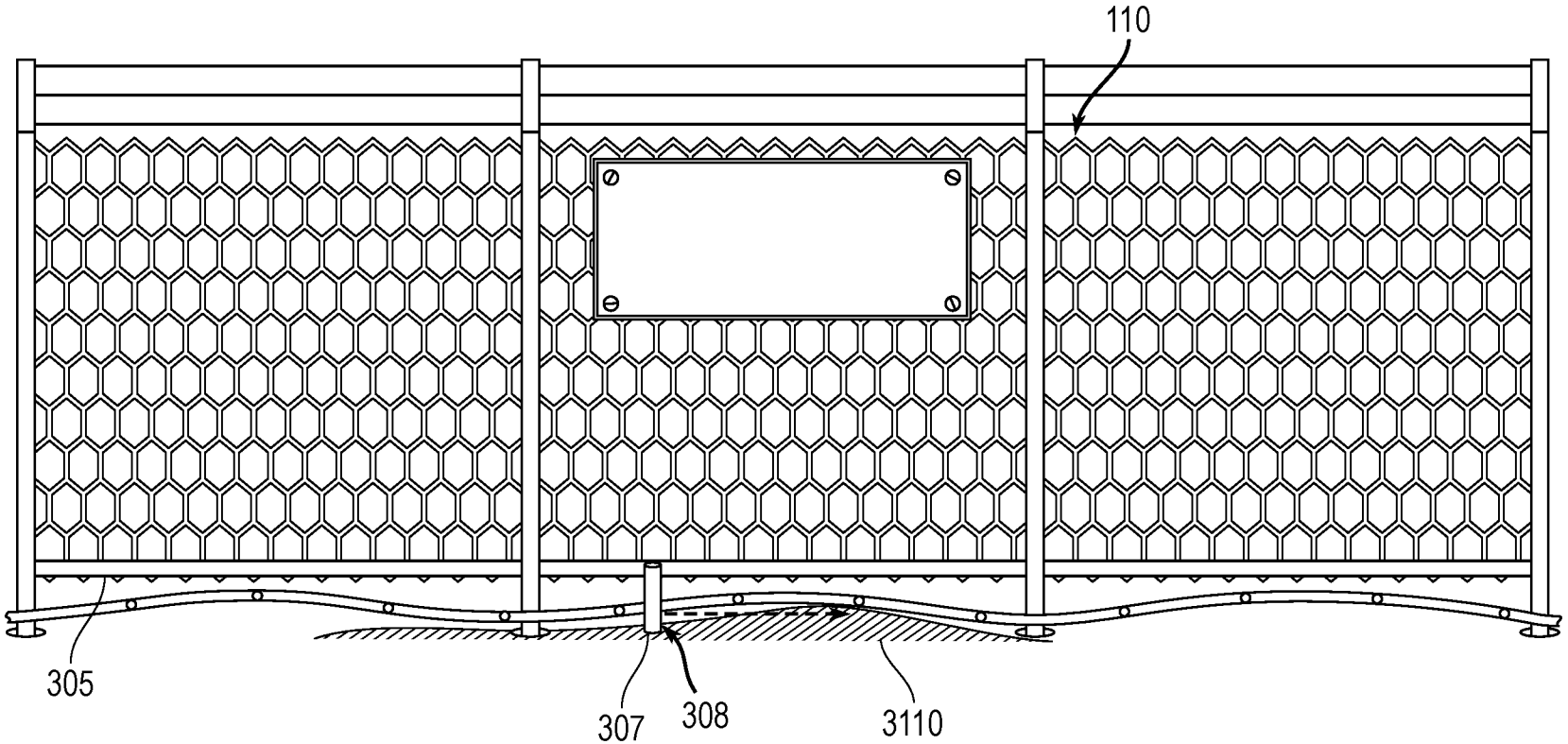

Referring next to FIG. 3B, as sensor 307 reaches the location of sand accumulation 1110, the accumulated sand abuts the outer surface of sensor 307 (for example, at the front surface 308 of sensor 307 indicated in FIG. 3B) as sensor 307 is passed through along track 305. Consequently, a resistance force is detected by sensor 307. The force detection is communicated to controller 215, which instructs a slowdown to sensor 307 and/or an activation to sand removal mechanism 210 in correspondence with the location of sensor 307. According to an exemplary embodiment, a predetermined force threshold is set for triggering sand removal mechanism 210, where controller 215 issues an activation instruction to sand removal mechanism 210 upon receiving a detected resistance force from sensor 307 that exceeds the predetermined threshold.

Figure 3C:
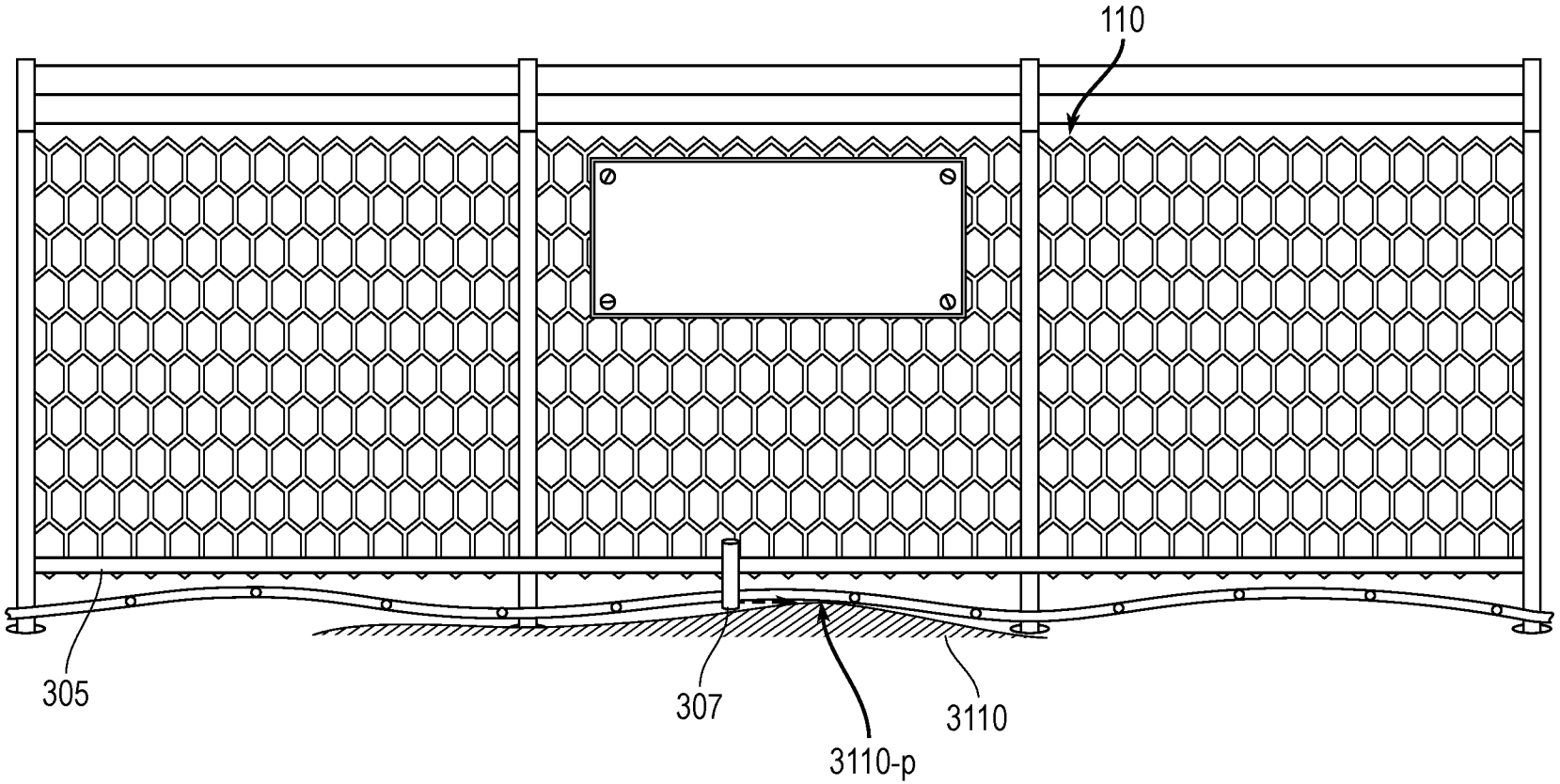

According to another exemplary embodiment, controller also issues an instruction for slowing the movement of sensor 307 upon detecting a resistance force, as illustrated by the shortened rightward dash arrow in FIG. 3C. The purpose of the slowdown is to assess the size of sand accumulation 3110. As an example, controller 215 can issue a slowdown instruction to the linear motor (not shown) of track 305 and sensor 307 when sensor 307 detects the resistance force from sand accumulation 3110. Correspondingly, sensor 307 further incorporates another actuator (not shown) that allows the elongate shape portion to be moved upward when detecting sand accumulation 3110. In concurrence with the slowdown instruction, controller 215 instructs the additional actuator (not shown) to raise sensor 307, as illustrated in FIG. 3C. The force detection is monitored so that sensor 307 is raised continually until a resistance force is no longer detected by sensor 307. As illustrated in FIG. 3C, sensor 307 is raised above the top portion of sand accumulation 3110. However, a resistance force is detected again as sensor 307 continues to be moved slowly towards peak 3110-*p* of sand accumulation 3110. Accordingly, controller 215 raises sensor 307, again, until sensor 307 clears peak 3110-*p* and no longer detects a resistance force. In this manner, sensor 307 and controller 215 detect and record a height of peak 3110-*p* as well as the height and breadth dimensions of sand accumulation 3110 as sensor 307 is moved along track 305, thereby detecting the height and size of sand accumulation 3110. In other words, the total distance the elongate portion of sensor 307 is moved upwards until a top point is the height of peak 3110-*p* of accumulated sand 3110. In correspondence with the aforementioned force threshold, a size threshold is set for triggering sand removal mechanism 210, where controller 215 issues an activation instruction to sand removal mechanism 210 upon sensor 307 detecting a sand accumulation that exceeds the predetermined size threshold. In embodiments, the size threshold can be a height threshold.

Figure 3D:
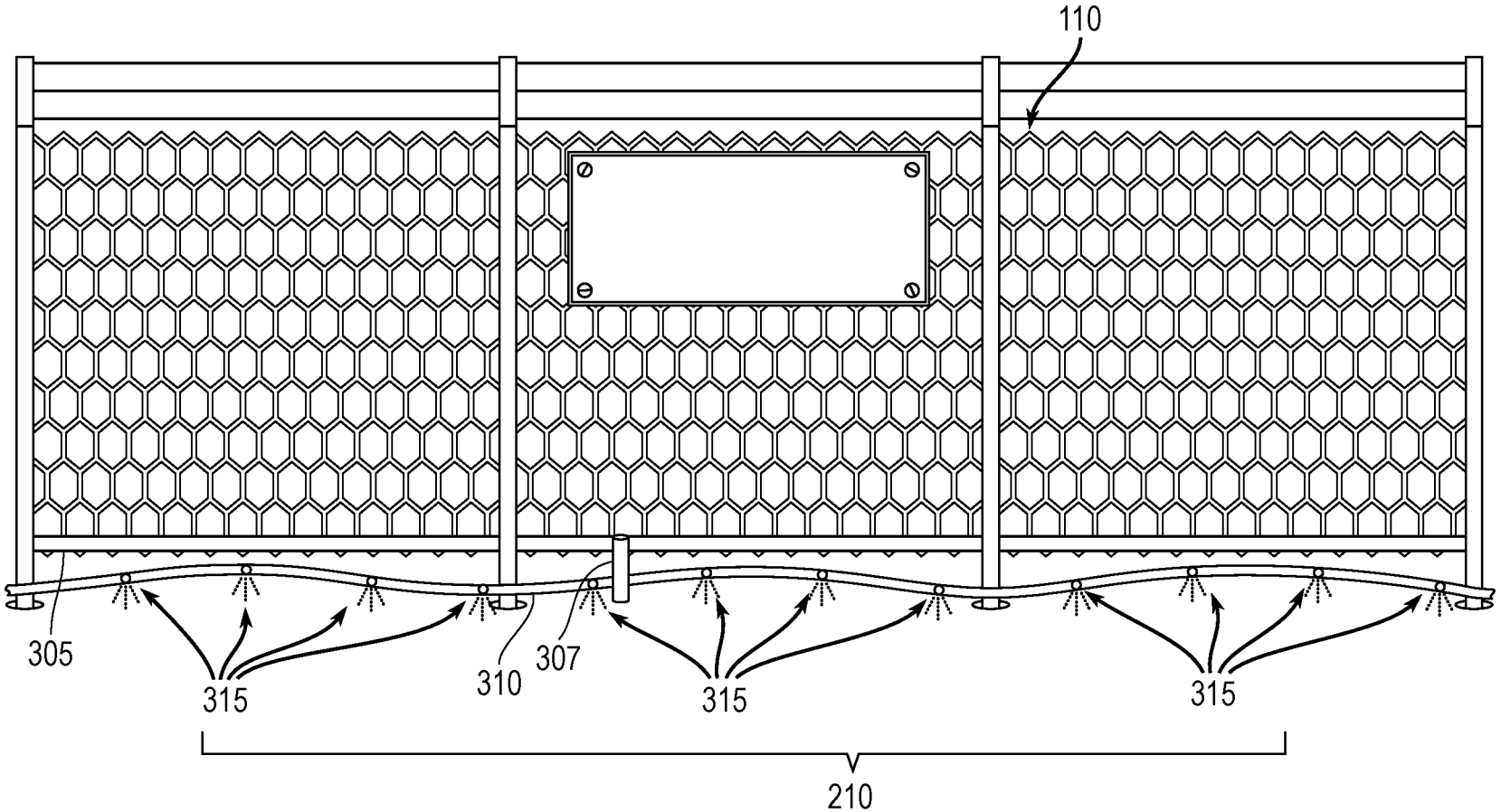

FIG. 3D includes reference numerals for illustrating an exemplary embodiment of sand removal mechanism 210. As shown in FIG. 3D, sand removal mechanism 210 includes pressurized air tubing 310, which incorporates plural nozzles 315 that are directed outwards from site 100, disposed along the bottom portion of fencing 110 in correspondence with track 305. Tubing 310, which can be resilient or rigid tubing depending upon the characteristics of site 100, is connected to a pressurized air source (not shown), such as a pump, a tank, and the like, via an activation valve (not shown). In embodiments, tubing 310 is anchored to fencing 110 to provide stability for releasing the pressurized air. The activation valve (not shown) is activated by controller 215 upon meeting the sand detection conditions described above with reference to FIGS. 3A-3C. FIG. 3D illustrates an activation of nozzles 315 for removing sand accumulation 3110 upon sensor 307 detecting a resistance force that exceeds a predetermined threshold at the position shown in FIG. 3B. As shown in FIG. 3D, pressurized air (or gas) is released from nozzles 315 towards an exterior of fencing 110 to blow sand accumulation 3110 at fencing 110 outward away from site 100. As described before, activation of nozzles 315 can also result from the size determination illustrated in FIG. 3C exceeding a predetermined threshold.

According to an exemplary embodiment, sections of fencing 110 are each provided with independently controlled tubing sections (310) such that only nozzles (315) within the section of the detected sand accumulation are activated. In embodiments, nozzles 315 can be individually activated by controller 215 for more precise application of the pressurized air in correspondence with the location of the detected sand accumulation (3110).

Figure 3E:
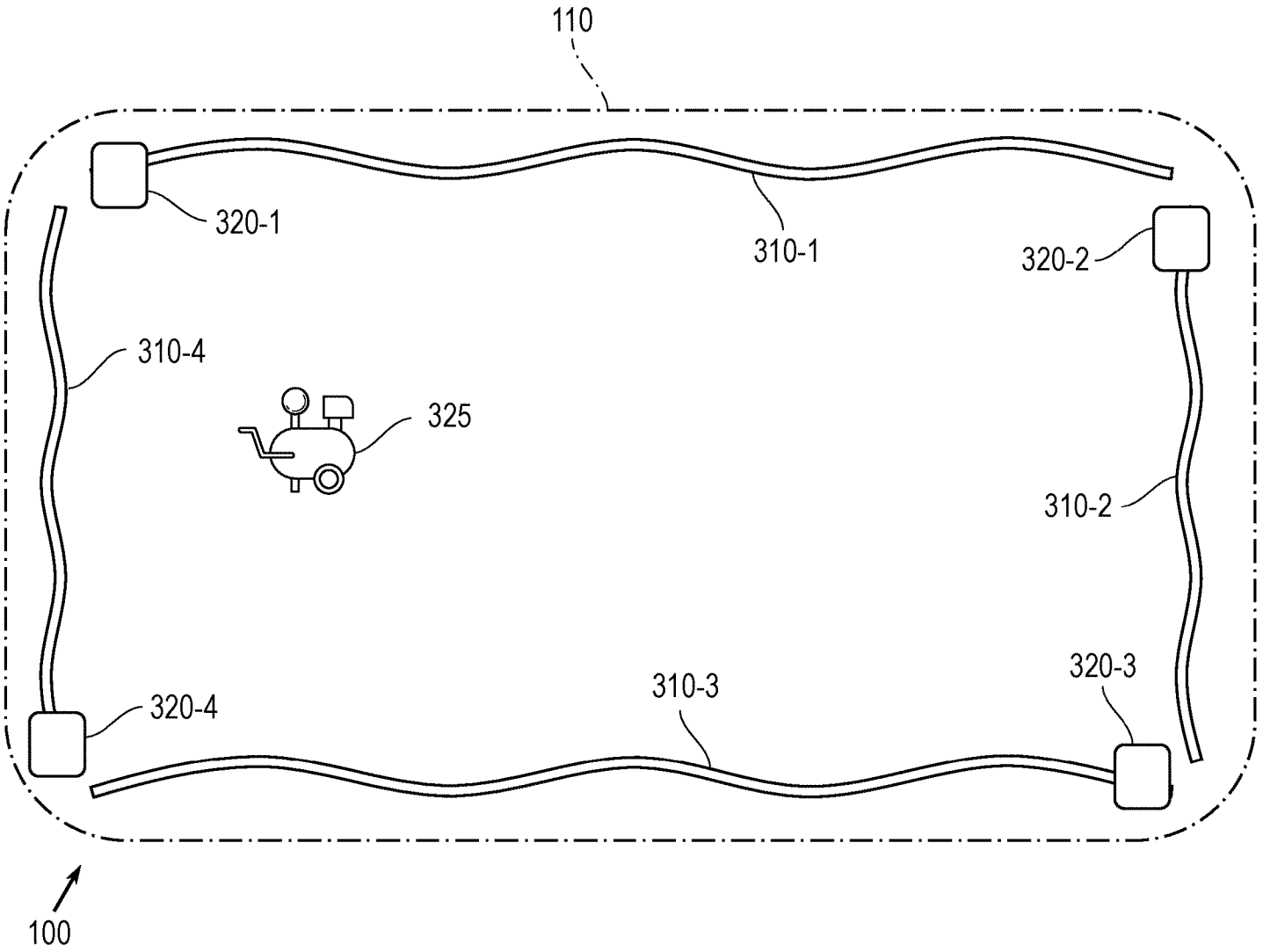
FIG. 3E is a top plan view graphical illustration of tubing sections coupled to respective air source conduits for a sand removal mechanism in accordance with an exemplary embodiment of the present disclosure.

FIG. 3E is a top plan view graphical illustration of tubing sections 310-1 . . . 310-4 coupled to respective air source conduits 320-1 . . . 320-4 in accordance with an exemplary embodiment of the present disclosure. Conduits 320-1 . . . 320-4 incorporate activation valves (not shown) and incorporate a coupling for receiving and connecting to autonomous mobile air pump 325, which is controlled to move around the interior of fencing 110. According to an exemplary embodiment mobile air pump 325 incorporates controller 215 or is in communication with controller 215. When sensor 307 detects an accumulation and determines its height as described above, mobile air pump 325 is activated by controller 215 to connect with the connection conduit (320-1, 320-2, 320-3, or 320-4) corresponding to the location of sensor 307 that sensed the resistance force. Once connected, mobile air pump 325 pumps pressurized air through the corresponding tubing section (310-1, 310-2, 310-3, or 310-4) and its corresponding nozzles (not shown) to blow the detected sand away. According to an exemplary embodiment, if the determined height of the accumulation exceeds a "high" threshold, an additional pump (not shown) is directed to the same location to cooperate with mobile air pump 325—for example, by connecting to another coupling in the same conduit (320-1, 320-2, 320-3, or 320-4)—to clear the accumulation faster. In embodiments, controller 215 can distribute the above-described sand removal among multiple mobile pumps, especially for sites (100) that encompass large areas, such that mobile pumps can be assigned to respective portions of a site (100). In embodiments, sections of tubing 310-1 . . . 310-4 can be independently connected to corresponding one or more stationary air sources, such as air tanks and the like, and corresponding stationary activation valves 320-1 . . . 320-4 are selectively activated by controller 215 in accordance with the above-described sand accumulation detection and removal processes.

After clearing the sand, sensor 307 resumes its default movement operation depicted in FIG. 3A. From the position shown in FIG. 3C, sensor 307 is also moved back down to its original level to resume its horizontal movement around fencing 110 until sensor 307 reaches another spot with sand accumulation. According to an exemplary embodiment, sensor 307 is deployed to cover a complete route along track 305 on a periodic schedule, which can be adjusted based on a frequency of sand accumulation detection.

According to an exemplary embodiment, the sand accumulation locator assembly 205 that employs track 305 and sensor 307, along with the sand removal mechanism 210 that employs tubing 310 and nozzles 315, are suitable for sites located in regions with low or mid-intensity of sand accumulation. Advantageously, the embodiment capitalizes on existing structures, such as fencing 110 of the communication sites (100).

According to an exemplary embodiment, a built-in camera (not shown) is attached to the elongate portion of sensor 307 to monitor the performance of sensor 307 and the air pumps (not shown) of sand removal mechanism 210. The built-in camera (not shown) sends all data to control device 225, network 220, and/or information system 250. An operator can control the camera using control device 225 and user interface 245. As an example, if an object is obstructing the movement of sensor 307, the camera can send live images to an operator at control device 225 to take necessary actions, such as removing the obstruction. As another example, if sensor 307 detects a resistance in a same location multiple times, it can indicate a performance issue with either sensor 307 or elements of the sand removal mechanism 210. Thus, the built-in camera (not shown) can send pictures to an operator to identify the issue and troubleshoot remotely, if possible, or mobilize to the site to resolve the issue. Additionally, the camera can be integrated with a Communication Supervisory Alarm System (CSAS) (not shown), which can be communicatively connected to system 200 via network 220 illustrated in FIG. 2, to send/receive data to/from operators. Accordingly, the CSAS can monitor the sand level, alert operators of any system malfunctions, and send live images of the site, which enhances the operators' response and decision-making significantly. Furthermore, the camera (not shown) and sensor 307 collect all data related to sand accumulation and stores them in information system 250 for analysis. Programmed expert systems, machine learning algorithms, and the like, can be executed to analyze data stored in information system 250 via network 220 to, for example, learn sand activity corresponding to different parts of the year, particular portions of site 100 that tend to accumulate sand, and so on. By such training, system 200, with time, can be improved to be more efficient in clearing sand accumulation and/or reduce power consumption while maintaining the same high efficiency of clearing the sand.

Figure 4A:
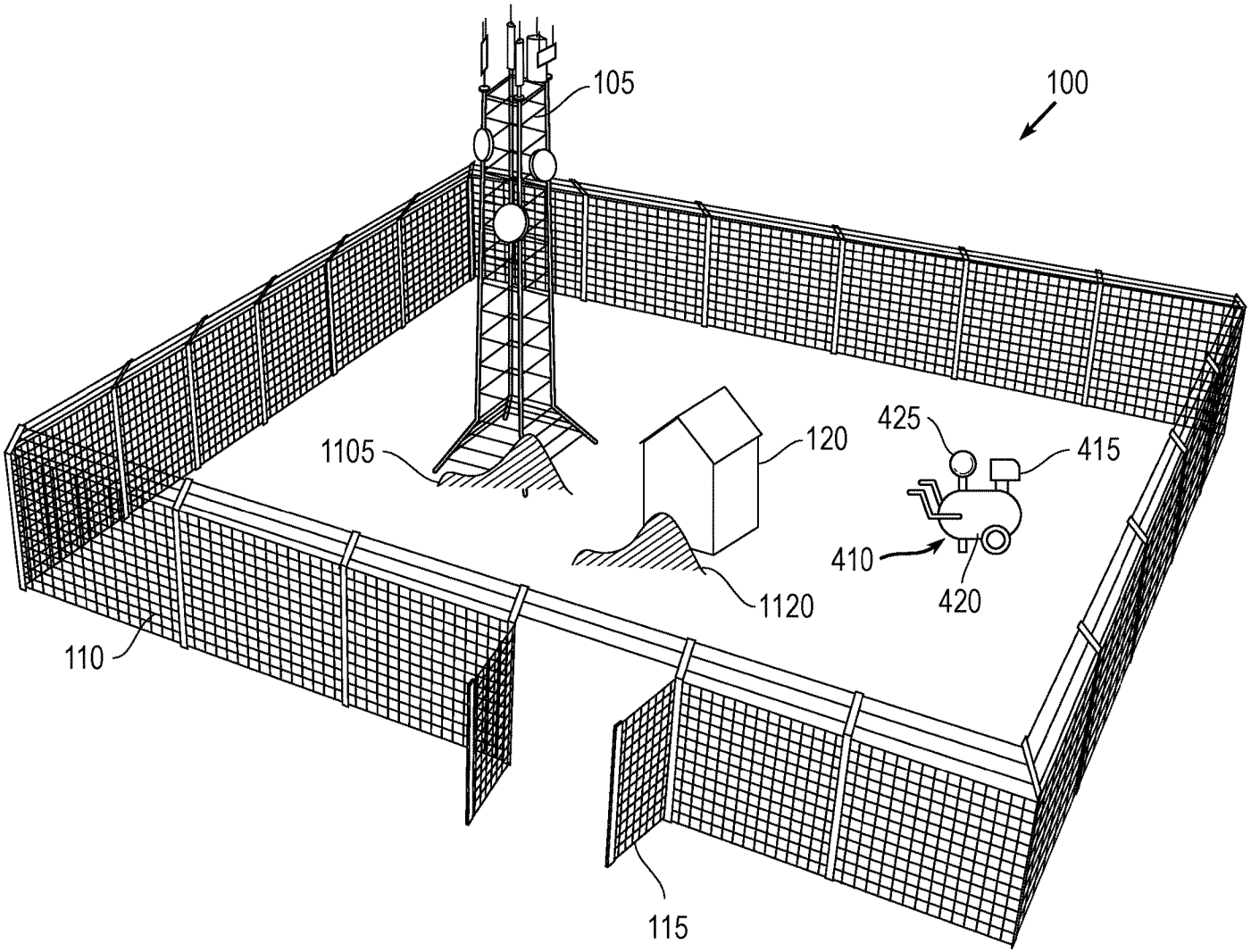
FIG. 4A is a graphical illustration of a mobile sand detection mechanism and a sand removal mechanism that are embodied by an autonomous pump vehicle according to an exemplary embodiment of the present disclosure.

FIG. 4A is a graphical illustration of a mobile sand detection mechanism that is embodied by an autonomous pump vehicle 410 according to an exemplary embodiment of the present disclosure. Vehicle 410 incorporates a vacuum pump 415, a container 420, and a container content weight detector 425. According to an exemplary embodiment, controller 215 is incorporated in vehicle 410 for controlling vehicle 410 to move about site 100 according to algorithmic programming. In embodiments, a separate control processing mechanism (not shown) can be integrated in vehicle 410 for wired couplings or wireless communications with controller 215 and/or control device 225 to program and determine the path taken by vehicle 410 in site 100 for efficiently covering an area to detect sand accumulations.

While vehicle 410 is traversing a predetermined path within site 100 according to algorithmic programming, vacuum pump 415 is activated periodically to extract any debris at the location of vehicle 410 into container 420. The contents of container 420 are monitored by container content weight detector 425 and when the weight the contents within container 420 exceeds a predetermined threshold, the location of vehicle 410 is recognized by system 200 as having a sand accumulation. For example, with reference to FIG. 4A, when vehicle 410 travels to the location of sand accumulation 1105 or 1120 and a sufficient amount of the sand is vacuumed into container 420. Container content weight detector 425 detects the weight within container 420 as exceeding the threshold and controller 215, thus, recognizes that the location of vehicle 410, at sand accumulation 1105 or 1120, is a location with accumulated sand. Accordingly, upon detecting such a location, vehicle 410 enters a sand removal mode and embodies sand removal mechanism 210 in accordance with an exemplary embodiment of the present disclosure. In embodiments, vehicle 410 can incorporate controller 215, or an independent control processor (not shown) in communication with controller 215, that is preprogrammed to enter the sand removal mode in response to the weight threshold trigger described above. Correspondingly, vehicle 410 is programmed to scan site 100 regularly based on preference parameters, which can be set by an operator at control device 225, and/or preprogrammed site conditions. In embodiments, multiple vehicles (410) can be deployed based on the size, terrain, and other characteristics of a site (100). To ensure smooth operation of vehicle 410 in sand, caterpillar treads/chain tracks can be incorporated.

Once vehicle 410 detects accumulated sand, controller 215 interrupts the predetermined path of vehicle 410 and enters a sand removal mode to remove the detected sand accumulation. In the sand removal mode, vehicle 410 activates vacuum pump 415 persistently to vacuum the located sand until container content weight detector 425 detects a weight that indicates a filled container 420. When container 420 is filled, vehicle 410 is controlled to travel to a nearest peripheral location at fencing 110 to empty container 420 towards the exterior of site 100. Upon emptying container 420, vehicle 410 is controlled to return to the located sand accumulation (1105 or 1120) and to repeat the sand removal mode operation of activating vacuum pump 415 to clear the accumulated sand. The located sand accumulation (1105 or 1120) corresponds to the location on the predetermined sand detection path of vehicle 410 at which the weight increase is detected by container content weight detector 425 and the predetermined path is interrupted to enter the sand removal mode. The sand removal and container emptying processes are repeated as needed until container content weight detector 425 fails to detect any weight increase at the located sand accumulation (1105 or 1120), which indicates clearance of the located sand accumulation. Once a located sand accumulation is cleared, vehicle 410 is controlled to re-enter a sand detection mode and resumes its predetermined path of covering site 100 for the purpose of detecting additional sand accumulations.

Figure 4B:
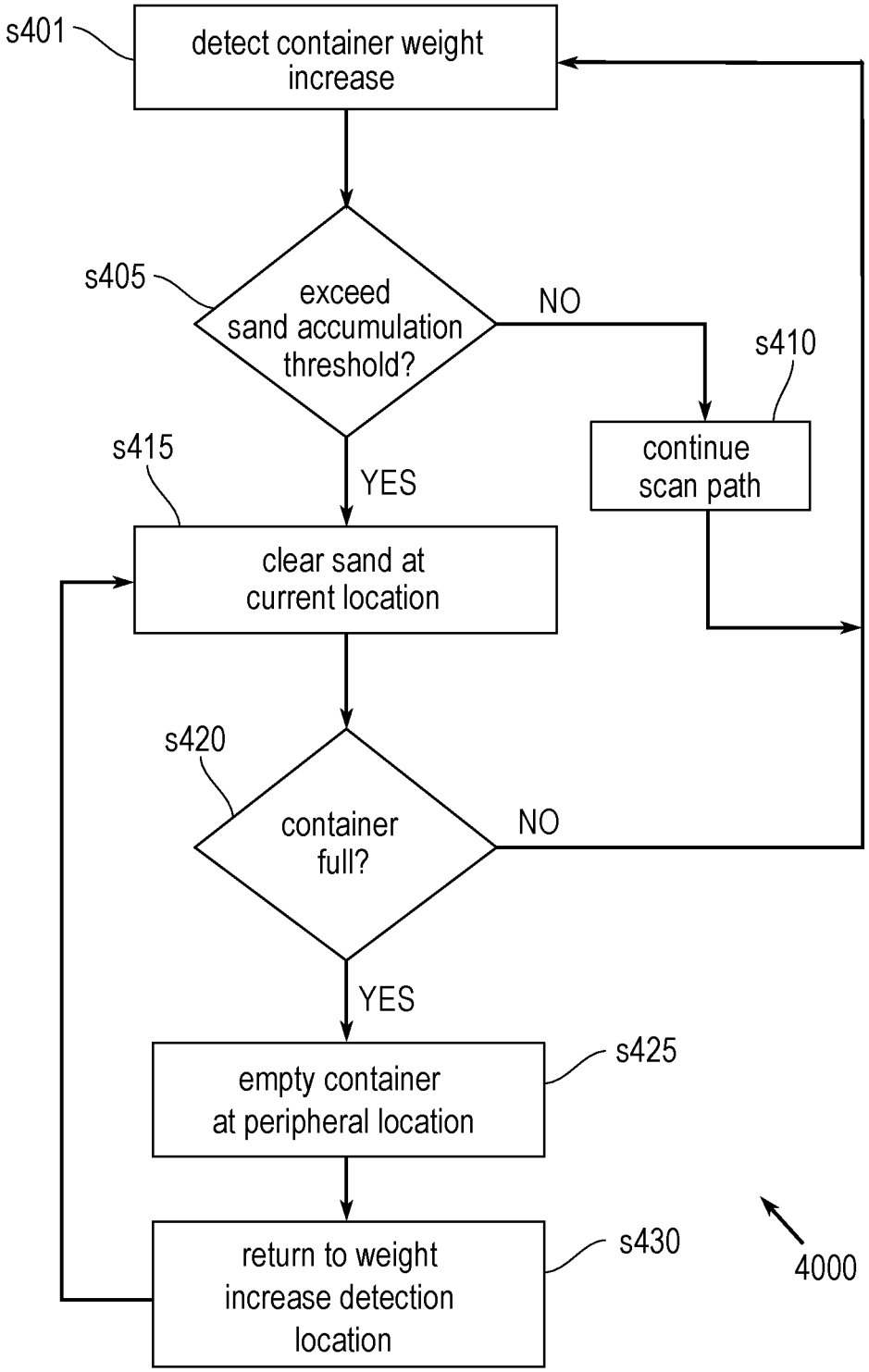
FIG. 4B is a flow diagram illustrating a process of the vehicle of FIG. 4A for operating in sand detection (scanning) and sand removal modes according to an exemplary embodiment of the present disclosure.

FIG. 4B is a flow diagram illustrating a process 4000 of vehicle 410 for operating in the sand detection (scanning) and sand removal modes according to an exemplary embodiment of the present disclosure. As shown in FIG. 4B, process

4000 initiates with step s401, where container content weight detector 425 determines whether there is a weight increase in container 420. In embodiments, this determination can be a monitoring process that is persistently executed, or it can be activated in correspondence with activations of vacuum pump 415. Process 4000 proceeds to step s405, where controller 215 determines whether any detected container weight increase exceeds a sand accumulation threshold.

If the weight increase does not exceed the sand accumulation threshold ("No"), process 4000 proceeds to step s410, where vehicle 410 continues on its predetermined scan path for covering site 100. Thereafter, process 4000 re-initiates to continuously monitor the weight of container 420 as vehicle 410 scans and vacuums across site 100.

If the weight increase exceeds the sand accumulation threshold ("Yes"), process 4000 proceeds to step s415, where vehicle 410 interrupts its scan path and clears the detected sand accumulation at its current location. Next, at step s420, controller 215 determines whether the weight detected by container content weight detector 425 indicates a full container.

If container 420 is not full ("No"), process 4000 re-initiates to monitor the weight of container 420 as the detected sand is being cleared. Thus, when process 4000 reaches step s405 again, controller 215 can determine whether the detected sand accumulation has been cleared by determining whether any weight increase of container 420 exceeds the sand accumulation threshold. If not ("No"), then it is an indication that the accumulated sand has been cleared and vehicle 410 can return to scanning site 100, at step s410.

If controller 215 determines that container 420 is full ("Yes"), process 4000 proceeds to step s425, where vehicle 410 is directed to a peripheral location at fencing 110 to empty container 420. Next, at step s430, vehicle 410 is returned to the location at which the excessive container weight increase was detected and process 4000 returns to step s415 for clearing the sand at that location. Thus, the looped process 4000 returns to monitoring the container weight and proceeds accordingly—either continuing to clear the detected sand or returning to scan site 100 once the detected sand has been cleared.

According to an exemplary embodiment, the sand accumulation locator assembly 205 and the sand removal mechanism 210 that employ vehicle 410 are suitable for sites located in regions with mid to high intensity of sand accumulation. According to an exemplary embodiment, vehicle 410 also incorporates a built-in camera (not shown). The operations, purpose, and advantages of such a built-in camera correspond to those of the built-in camera for sensor 307 described above, which will not be repeated here.

Next, exemplary embodiments of sand accumulation locator assembly 205 that incorporate one or more surface condition detectors and one or more elevated position condition detectors will be described with reference to FIGS. 5A, 5B, and 6.

Figure 5A:
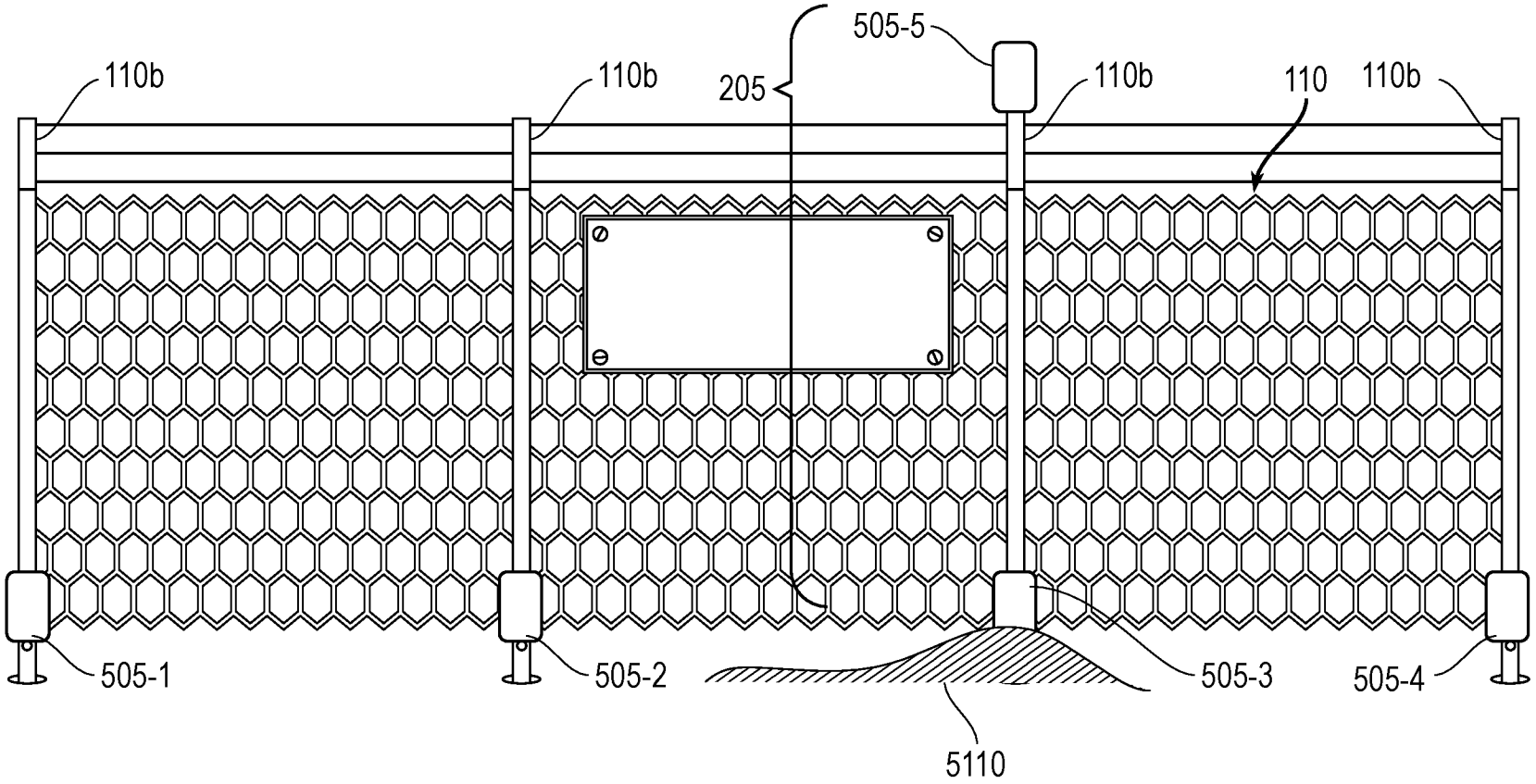
FIGS. 5A and 5B are graphical illustrations of an operation for an exemplary implementation of a sand accumulation locator assembly, which incorporates one or more surface condition detectors and one or more elevated position condition detectors, and a sand removal mechanism according to the present disclosure.
Figure 5B:
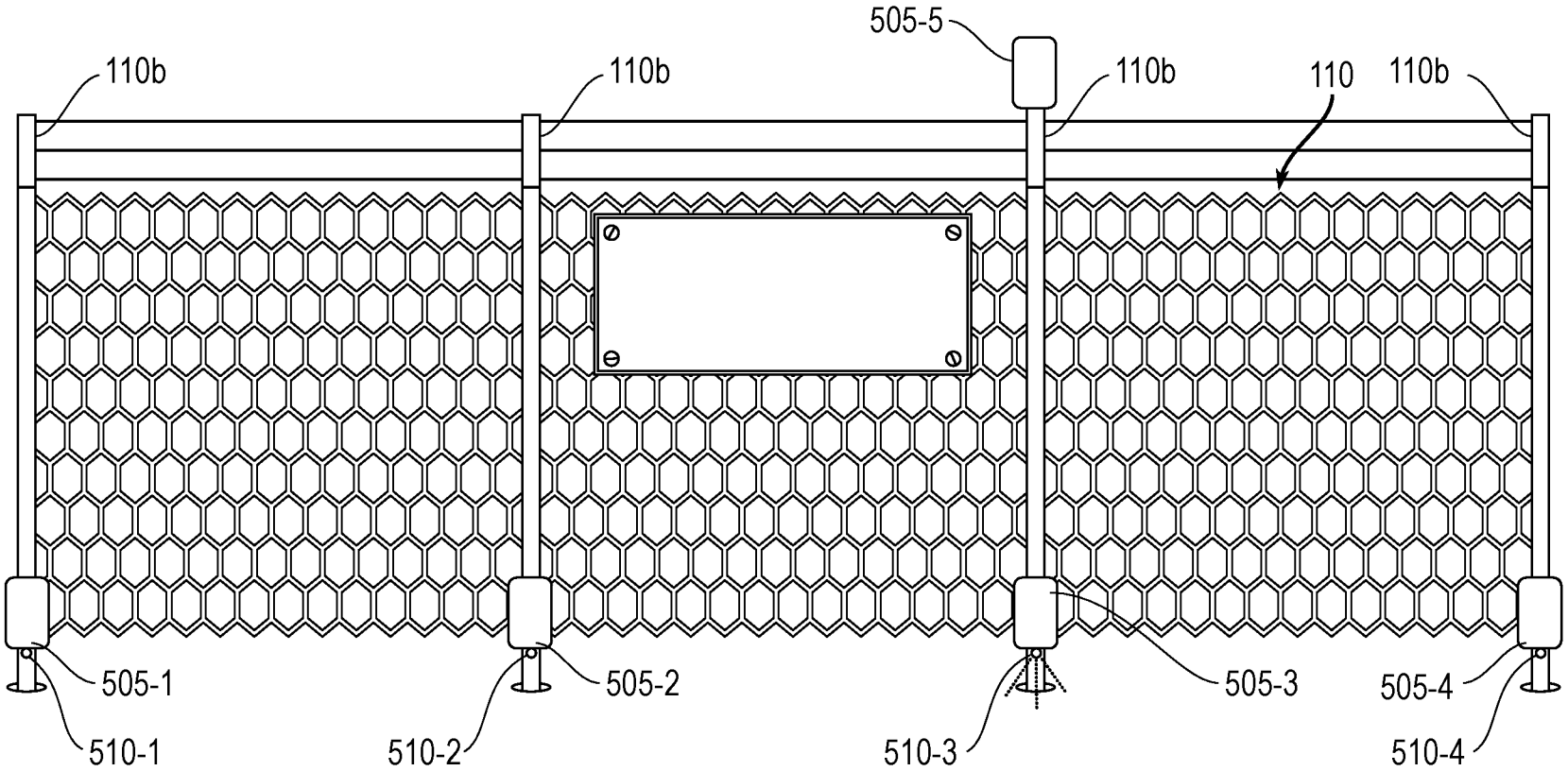

FIGS. 5A and 5B are graphical illustrations of an operation for an exemplary implementation of sand accumulation locator assembly 205 and sand removal mechanism 210 for detecting and removing a sand accumulation 5110 at fencing 110 according to the present disclosure. As illustrated in FIG. 5A, sand accumulation locator assembly 205 includes a plurality of surface condition detectors embodied by respective temperature detectors 505-1, 505-2, 505-3, and 505-4 disposed at bottom portions of beams 110*b* of fencing 110. According to an exemplary embodiment, an elevated position condition detector is embodied by another temperature detector 505-5 disposed at a top portion of one of the fencing beams 110*b*. In embodiments, multiple temperature sensors (not shown) can be deployed at the top portion of fencing 110 around site 100 illustrated in FIG. 1 at locations that correspond to those of temperature detectors 505-1, 505-2, 505-3, and 505-4 or additional surface condition detectors. In embodiments, particularly for regions with low sand accumulation, and as illustrated in FIG. 5A, sand accumulation locator assembly 205 can be embodied by a pair of temperature sensors 505-3 and 505-5 disposed at a bottom portion and a top portion of fencing 110, respectively.

As illustrated in FIG. 5A, temperature (thermal) sensor 505-5 at the top of the fencing 110 measures the air temperature at site 100. Correspondingly, each of temperature sensors 505-1, 505-2, 505-3, and 505-4 at the bottom of fencing near the ground level, which is a substantially horizontal surface, measure the temperature at their respective surrounding areas. When there is no sand accumulation, bottom sensors 505-1, 505-2, and 505-4 detect the same air temperature as sensor 505-5 and, thus, there is no difference between the readings among these sensors. However, if there is sand accumulation 5110, the bottom sensor 505-3 reads the temperature of the sand, which is different from the temperature reading of the top sensor 505-5. In other words, when there is a temperature difference between the top sensor 505-5 and one or more of the bottom sensors 505-1, 505-2, 505-3, and 505-4, system 200 recognizes that there is sand accumulation and starts a sand clearing process. When there is no difference among the readings of the sensors 505, system 200 recognizes that there is no sand accumulation. Advantageously, the embodiment utilizes existing infrastructure—i.e., fencing 110—and provides constant passive monitoring for sand accumulation at fencing 110 without requiring energy consuming moving part elements.

FIG. 5B includes reference numerals for illustrating an exemplary embodiment of sand removal mechanism 210. As shown in FIG. 5B, sand removal mechanism 210 includes plural nozzles 510-1, 510-2, 510-3, and 510-4 that are directed outwards from site 100 and disposed at the bottom portions of fence beams 110*b* in correspondence with temperature sensors 505-1, 505-2, 505-3, and 505-4, respectively. According to an exemplary embodiment, each of the fence beams 110*b* is connected to a pressurized air source (not shown), such as a pump, a tank, and the like, via an activation valve (not shown) with internal channels directing the pressurized air from the respective sources to nozzles 510-1, 510-2, 510-3, and 510-4. The activation valves (not shown) are activated by controller 215 upon meeting the sand detection conditions described above with reference to FIG. 5A.

FIG. 5B illustrates an activation of nozzle 510-3 for removing sand accumulation 5110 upon temperature detector 505-3 detecting a temperature difference from the air temperature detected by detector 505-5 that exceeds a predetermined threshold. As shown in FIG. 5B, pressurized air (or gas) is released from nozzle 505-3 towards an exterior of fencing 110 to blow sand accumulation 5110 at fencing 110 outward away from site 100. In embodiments, additional beams (110*b*) can be added as needed to fencing 110 to increase the granularity of sand accumulation detection by temperature detectors (505) and removal by nozzles (510) around the perimeter of site 100. In embodiments, some or all of nozzles 510-1, 510-2, 510-3, and 510-4 can be activated upon temperature detector 505-3 detecting a temperature difference from the air temperature detected by detector 505-5 that exceeds a predetermined threshold. For example, particularly for regions with low sand accumulation, and as illustrated in FIG. 5A, sand accumulation locator assembly 205 can be embodied by a pair of temperature sensors 505-3 and 505-5 disposed at a bottom portion and a top portion of fencing 110, respectively.

According to an exemplary embodiment, the sand accumulation locator assembly 205 and the sand removal mechanism 210 that employ temperature sensors 505-1 . . . 505-5 and nozzles 510-1 . . . 510-4 are suitable for sites located in regions with low or mid-intensity of sand accumulation. According to an exemplary embodiment, a thermal camera (not shown) is installed on fencing 110 to monitor the level of the accumulated sand. The operations, purpose, and advantages of such a thermal camera correspond to those of the built-in camera for sensor 307 described above, which will not be repeated here.

Figure 6A:
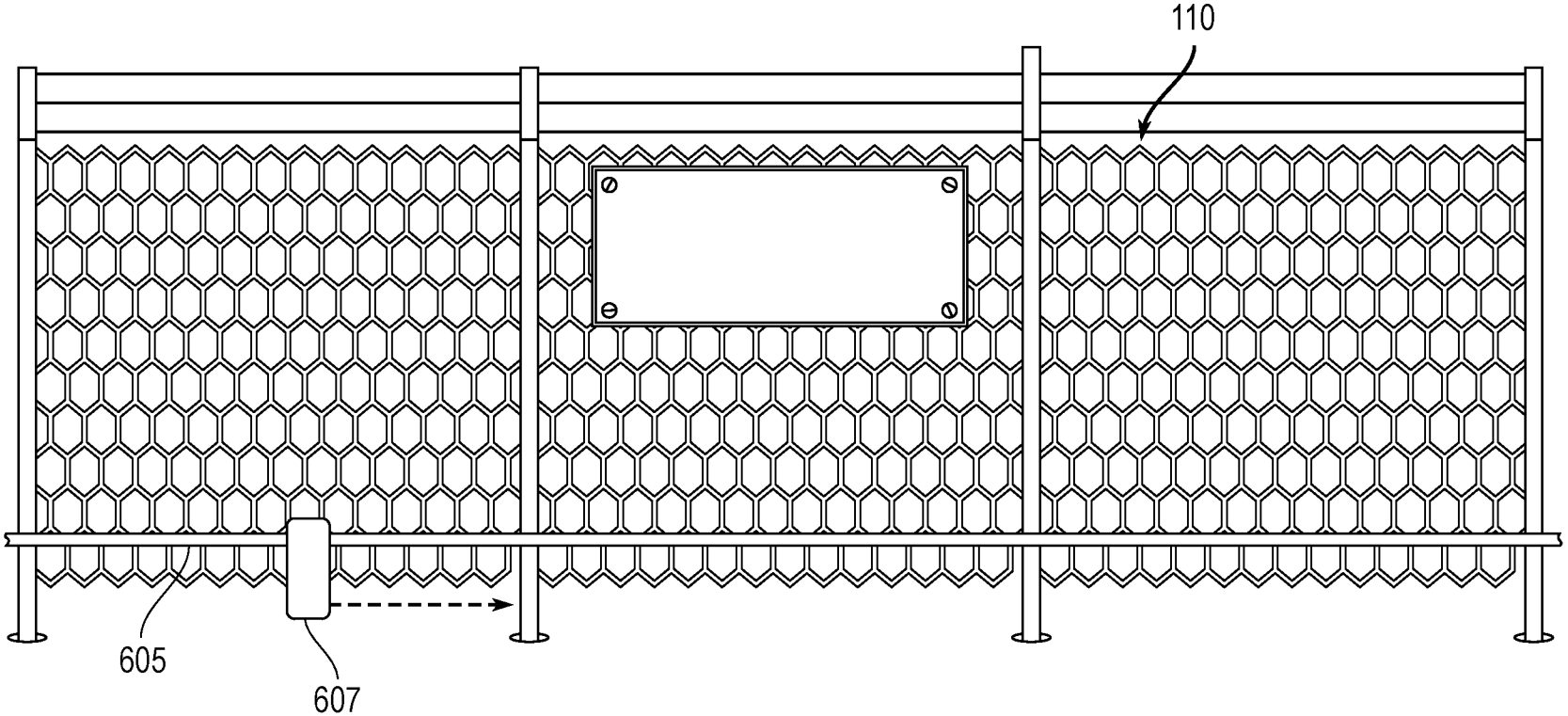
FIGS. 6A and 6B are graphical illustrations of a surface condition detector embodied by a Laser Distance Meter (LDS) and an elevated position condition detector embodied by an anemometer for a sand accumulation locator assembly according to an exemplary embodiment of the present disclosure.
Figure 6B:
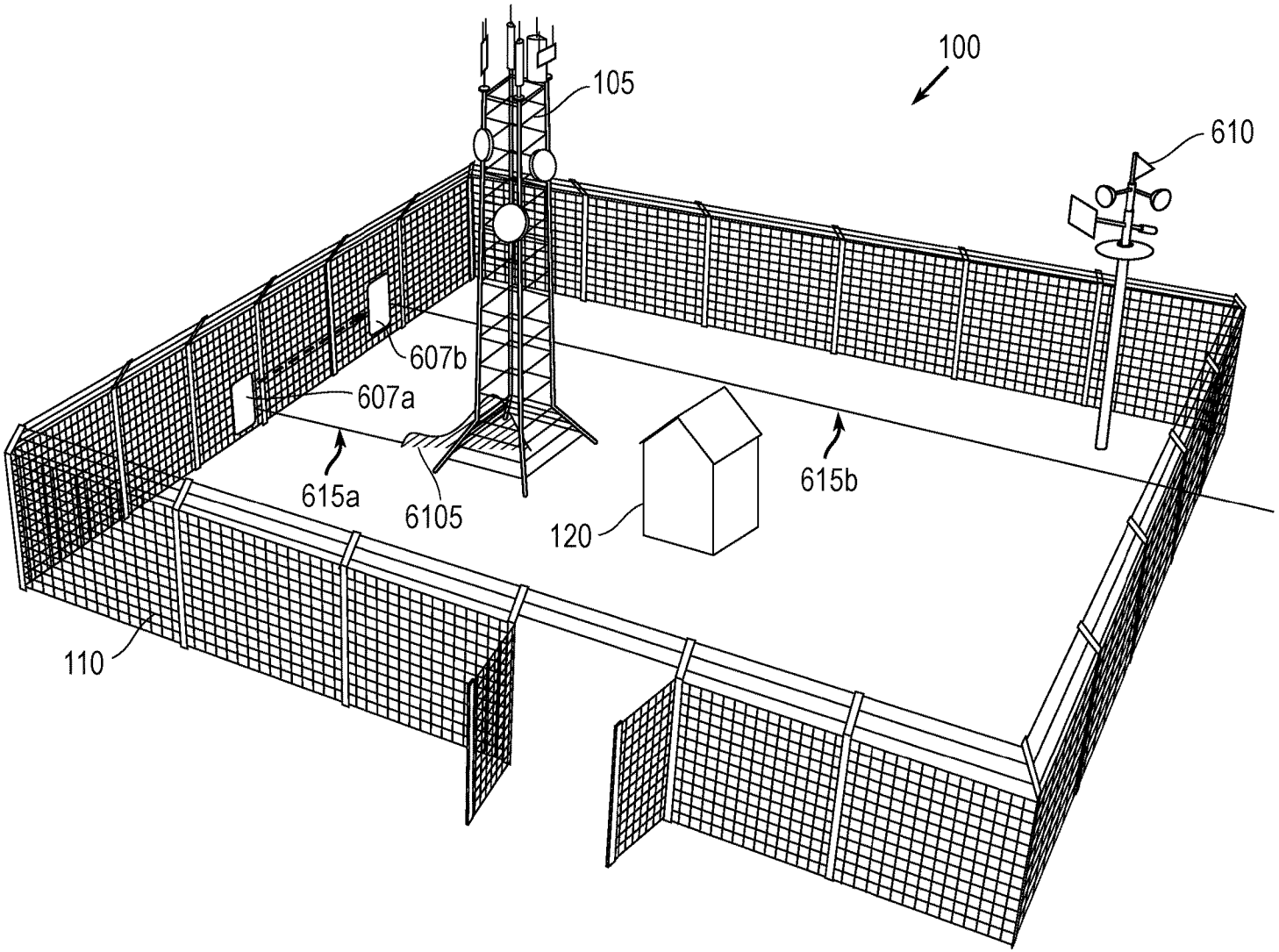

FIGS. 6A and 6B are graphical illustrations of a surface condition detector of sand accumulation locator assembly 205 embodied by a Laser Distance Meter (LDS) 607 and an elevated condition detector embodied by an anemometer 610. As illustrated in FIG. 6A, sand accumulation locator assembly 205 includes a track 605 that is disposed along a bottom portion of fencing 110 around site 100 (see also FIG. 6B for an illustration of fencing 110 around a perimeter of site 100). Track 605 provides a route (or path) along which LDS 607 can travel around the perimeter of site 100. Thus, LDS 607 also embodies a mobile sand detection mechanism adapted to traverse a path defined by track 605 in an enclosure formed by fencing 110. As illustrated in FIG. 6A, LDS 607 moves along track 605, as indicated by the rightward dashed arrow. Exemplary implementations of track 605 correspond to those of track 305 discussed above, with adjustments to the height of track 605 for accommodating LDS 607. Discussions of the exemplary embodiments of the track will not be repeated here.

With reference to FIG. 6B, LDS 607 is installed at a specific height on fencing 110 and moves horizontally around fencing 110. If laser beam (615) is disrupted by any object, the distance from fencing 110 to the point where the beam (615) is disrupted is calculated by LDS 607 and analyzed by controller 215 or LDS 607 itself. The width/length dimensions of site 100 is preprogrammed on LDS 607 or controller 215, and the actual reading of the beam disruption (the distance from LDS 607 to the point beam 615 is disrupted) with the preprogrammed dimensions. Thus, as illustrated in FIG. 6B, if LDS 607 is at position 607*a*, the actual reading for beam 615*a* is less than the preprogrammed dimension to equipment 105 and indicates sand accumulation 6105 inside site 100. Correspondingly, if LDS 607 moves to position 607*b* and the actual reading for beam 615*b* is larger than the preprogrammed dimensions of fencing 110, system 200 recognizes that the corresponding section in site 100 is clean and further actions are not needed. As with resistance sensor 307, LDS 607 is coupled to track 605 via an actuator (not shown) that is adapted to raise LDS 607 vertically to identify the height/level of any detected sand—for example, sand accumulation 6105. According to an exemplary embodiment, a height threshold is predetermined in LDS 607 or controller 215 to confirm that sand accumulation of sufficient size has been detected and that activate of sand removal mechanism 210 is warranted. After sand removal mechanism 210 is activated, LDS 607 resumes its scanning operation and returns to its original height for traveling around fencing 110 on track 605.

According to an exemplary embodiment, LDS 607 is scheduled to monitor site 100 at a frequency based on an operator's preferences. For example, LDS 607 can be scheduled to take a full round around fencing 110 once a week or once every three days, and so on. However, if a sandstorm is taking place, LDS 607 is controlled to operate continuously until the sandstorm has passed. A sandstorm is detected by the elevated position condition detector that is embodied by anemometer 610 illustrated in FIG. 6B. In embodiments, anemometer 610 can be installed on top of fencing 110. Anemometer measures wind speed and direction, and if the measured wind speed exceeds a predetermined value, controller 215 interprets the wind reading as an indication that a sandstorm is ongoing. According to an exemplary embodiment, the predetermined value for a sandstorm threshold is approximately 40 kilometers per hour (km/h), or 25 miles per hour (mph). Upon detecting a sandstorm, controller 215 triggers LDS 607 to operate continuously. When the wind speed detected by anemometer 610 decreases below another specific value, controller 215 interprets the wind reading as an indication that the sandstorm has ended. According to an exemplary embodiment, the specific value for indicating an end to a sandstorm is approximately 25 km/h, or 15.5 mph. Accordingly, upon detecting an end to a sandstorm, controller 215 triggers LDS 607 to return to its scheduled operation.

Figure 7:
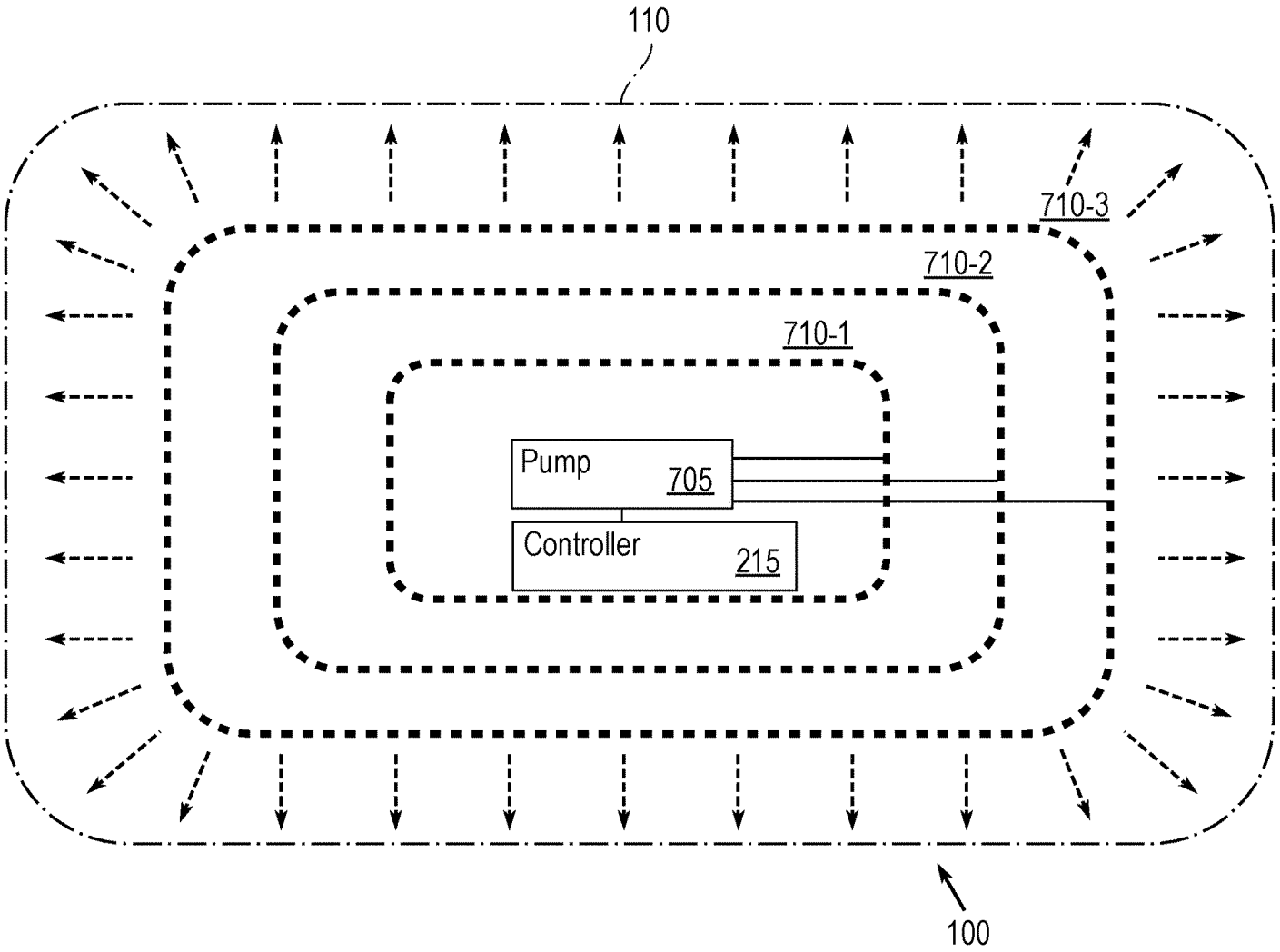
FIG. 7 is a schematic top plan view illustrating a pressurized air pump connected to arrays of nozzles for a sand removal mechanism in accordance with an exemplary embodiment of the present disclosure.

Sand removal mechanism 210 is embodied by arrays of nozzles installed on the ground of site 100 within the perimeter of fencing 110. FIG. 7 is a schematic top plan view illustrating a pressurized air pump connected to three (3) concentric arrays of nozzles 710-1, 710-2, and 710-3 in accordance with an exemplary embodiment of the present disclosure. In embodiments, nozzle arrays 710-1 . . . 710-3 can be hidden in the ground when not in use. In embodiments, nozzle arrays can be in different arrangements based on the contours and terrain of site 100. According to an exemplary embodiment, each nozzle of arrays 710-1 . . . 710-3 is controlled by controller 215 and is adaptable to change air flow pressure and direction to maximize the efficiency of system 200. As illustrated by outward dashed arrows in FIG. 7, nozzles of arrays 710-1 . . . 710-3 are directed generally outward from a center of site 100 towards the exterior of fencing 110 around site 100.

With reference to FIG. 6B, upon LDS 607 detecting of sand accumulation 6105, pump 705 is triggered to expel pressurized air through the nozzles of one or more of arrays 710-1 . . . 710-3 to clear the sand. As with the operating frequency of sand accumulation locator assembly 205 described before, there are two (2) general operating scenarios based on the wind speed detected by anemometer 610 for sand removal mechanism 210.

The first scenario is when anemometer 610 recognizes that a sandstorm is taking place. In this situation, the windspeed detected by anemometer 610 determines the flow power of the air expelled by pump 705. According to an exemplary embodiment, pump 705 incorporates multiple operating power levels and controller 215 sets the operating power of pump 705 based on the windspeed detected by anemometer 610 in the first operating scenario. In general, the air flow power from pump 705 is set by inverse proportionality to the detected windspeed. In other words, the higher the detected windspeed, the lower the operating power setting for pump 705. The purpose of this is to conserve energy consumed by pump 705 and maximize the overall efficiency of system 200. According to an exemplary embodiment, controller 215 further controls the direction of the nozzles in arrays 710-1 . . . 710-3 based on the direction of the wind detected by anemometer 610. In other words, nozzles of arrays 710-1 . . . 710-3 are directed to expel air in a direction that corresponds with a detected wind direction. In embodiments, controller 215 can control pump 705 and corresponding conduits or valves (not shown) to direct pressurized air to be expelled from a subset of the nozzles in arrays 710-1 . . . 710-3 that includes nozzles that are directed generally with the detected wind direction.

According to an exemplary embodiment, pump 705 operates continuously while in a sandstorm mode—i.e., when anemometer 610 detects a windspeed above a sandstorm threshold. In correspondence with this continuous operation of pump 705, as described before, sand accumulation locator assembly 205 employing LDS 607 also operates continuously during a sandstorm. If LDS 607 detects a sand accumulation, air flow power is increased for nozzles (710) that correspond to the detected sand accumulation—by increasing the air flow power from pump 705 and/or by closing other nozzles (710) that do not correspond to the detected sand accumulation.

When the detected windspeed does not exceed the sandstorm threshold or when the detected windspeed falls below the lower sandstorm-end threshold during a sandstorm, sand accumulation locator assembly 205 and sand removal mechanism 210 operate in a second, default operating scenario. In the default operating mode, LDS 607 operates according to a predetermined schedule at a set operating frequency—for example, once per week. If LDS 607 detects a sand accumulation, the height/level of the accumulation is determined. Based on both the location and level of the accumulated sand, controller 215 triggers pump 705 to operate with a power that is directly proportional to the detected level of sand. Correspondingly, controller 215 activates only the nozzles (710) that correspond to the detected sand accumulation. According to an exemplary embodiment, controller 215 executes an algorithm for activating and directing the nozzles (710) to intelligently drive the accumulated sand to the perimeter or exterior of fencing 110 through a shortest path. In accordance with an exemplary embodiment, the algorithm determines a sequence of the nozzles (710) that are activated to direct detected sand from a detected location to the perimeter or exterior of fencing 110. In embodiments, the sequence can include nozzles (710) that direct accumulated sand from one nozzle (710) to another nozzle (710) on an identified shortest path to the perimeter or exterior of fencing 110. As an example, with reference to FIG. 7, a sequence can include triggering first one or more nozzles of array 710-1, then triggering one or more nozzles of array 710-2, and finally triggering one or more nozzles of array 710-3 to direct accumulated sand from an interior location in site 100 towards the perimeter or exterior of fencing 110 around site 100.

According to an exemplary embodiment, the sand accumulation locator assembly 205 and the sand removal mechanism 210 that employ LDS 607, anemometer 610, pump 705, and nozzle arrays 710-1 . . . 710-3 are suitable for sites located in regions with mid or high-intensity of sand accumulation. According to an exemplary embodiment, LDS 607 monitors the level of the accumulated sand and controller 215, in cooperation with control device 225 and/or information system 250, provides intelligent feedback on the performance of system 200 on detecting and clearing sand accumulation. In embodiments, LDS 607 can be integrated with the CSAS to send/receive data to/from operators. Additionally, data collected by LDS 607 and anemometer 610 is forwarded to information system 250 for analysis and system improvement. As an example, system 200 can learn which part of the year sandstorms are more frequent and severe, or which location in site 100 usually accumulates the most sand, and so on. In embodiments, programmed expert systems, machine learning algorithms, and the like, can be executed (e.g., by control device 225 or the like) to analyze data stored in information system 250 via network 220 to improve system 200 in efficiency in clearing sand accumulations and in reducing power consumption.

As described above, the sand removal system 200 of the present disclosure integrates with existing infrastructure at remote communication sites. In embodiments, system 200 can be integrated with weather forecast systems—for example, via network 220—to enhance operations based on forecasted weather conditions. As an example, anticipated severe weather can trigger system diagnostics to identify any maintenance services needed for system 200.

As described above, control device 225 can be located remotely from system 200 and an operator can control operations of system 200 from a remote location by communicating instructions thereto via network 220.

System 200 can be powered by utility power and incorporates the capability to be powered by renewable energy. According to an exemplary embodiment, for remote site locations in regions with low or mid-intensity of sand accumulation, a suitable power supply for system 200 can be solar energy. For remote site locations in regions with high intensity of sand accumulation, based on higher windspeeds, wind energy generation can be suitable for powering system 200.

It should be understood by one of ordinary skill in the art that elements from the exemplary embodiments of the present disclosure can be interchanged, combined, or replaced with one another to operate independently or in tandem to implement appropriate sand detection and removal mechanisms. As an example, tubing 310 and/or nozzles 510-1 . . . 510-4 (and their corresponding sand accumulation locator assemblies) can cooperate with vehicle 410 and/or nozzle arrays 710-1 . . . 710-3 by expelling any sand directed from an interior portion of site 100 to a peripheral location at fencing 110 outward to the exterior of fencing 110.

Portions of the methods described herein can be performed by software or firmware in machine readable form on a tangible (e.g., non-transitory) storage medium. For example, the software or firmware can be in the form of a computer program including computer program code adapted to cause the system to perform various actions described herein when the program is run on a computer or suitable hardware device, and where the computer program can be embodied on a computer readable medium. Examples of tangible storage media include computer storage devices having computer-readable media such as disks, thumb drives, flash memory, and the like, and do not include propagated signals. Propagated signals can be present in a tangible storage media. The software can be suitable for execution on a parallel processor or a serial processor such that various actions described herein can be carried out in any suitable order, or simultaneously.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

While the disclosure has described several exemplary embodiments, it will be understood by those skilled in the art that various changes can be made, and equivalents can be substituted for elements thereof, without departing from the spirit and scope of the disclosure. In addition, many modifications will be appreciated by those skilled in the art to adapt a particular instrument, situation, or material to embodiments of the disclosure without departing from the essential scope thereof. Therefore, it is intended that the disclosure not be limited to the particular embodiments disclosed, or to the best mode contemplated for carrying out this disclosure, but that the disclosure will include all embodiments falling within the scope of the appended claims.

The subject matter described above is provided by way of illustration only and should not be construed as limiting. Various modifications and changes can be made to the subject matter described herein without following the example embodiments and applications illustrated and described, and without departing from the true spirit and scope encompassed by the present disclosure, which is defined by the set of recitations in the following claims and by structures and functions or steps which are equivalent to these recitations.

What is claimed is:

1. A system for detecting and locating sand accumulation in an enclosure and for removing the detected and located sand accumulation, comprising:

a sand accumulation locator assembly adapted to detect and locate one or more accumulations of sand in the enclosure;

a sand removal mechanism adapted to remove the detected one or more accumulations of sand;

a controller communicatively coupled to the sand accumulation locator assembly and the sand removal mechanism, said controller being adapted to:

control the sand accumulation locator assembly to detect and locate the one or more accumulations of sand in the enclosure; and control the sand removal mechanism to remove the one or more detected accumulations of sand based on corresponding one or more locations of accumulated sand detected by the sand accumulation locator assembly; and a monitoring apparatus communicatively coupled to the controller and adapted to monitor performances of the sand accumulation locator assembly and the sand removal mechanism, said monitoring apparatus comprising an alert indicator for issuing an alert to an operator upon detecting a malfunction or failure.

2. The system of claim 1, wherein the sand accumulation locator assembly comprises a mobile sand detection mechanism adapted to traverse a path in the enclosure, said mobile sand detection mechanism comprising a detector adapted to detect a sand accumulation at a position on the path of the mobile sand detection mechanism.

3. The system of claim 2, wherein the detector comprises a resistance detecting member that traverses the path along a track disposed proximate a substantially horizontal surface in the enclosure, wherein the resistance detecting member extends towards the substantially horizontal surface while traversing the path and detects the sand accumulation upon detecting a resistance on an outer surface of the resistance detecting member while traversing the path.

4. The system of claim 3, wherein the track is disposed along a bottom portion of fencing around the enclosure.

5. The system of claim 2, wherein the sand removal mechanism comprises a plurality of air nozzles disposed along the path of the mobile sand detection mechanism, and the controller is further adapted to toggle at least a subset of the plurality of air nozzles corresponding to the position of the mobile sand detection mechanism upon the mobile sand detection mechanism detecting the sand accumulation.

6. The system of claim 2, wherein the mobile sand detection mechanism comprises a vehicle having a vacuum pump, a container, and a container content weight detector, the vehicle being controlled by the controller to traverse the path according to algorithmic programming.

7. The system of claim 6, wherein the container content weight detector detects the sand accumulation upon detecting a weight increase in connection with the container of the vehicle.

8. The system of claim 7, wherein the controller is further adapted to control the vehicle to interrupt the path and to remove the detected sand accumulation using the vacuum pump and the container of the vehicle at the position on the path of the mobile sand detection mechanism.

9. The system of claim 8, wherein the controller is further adapted to control the vehicle to empty the container at a peripheral location of the enclosure upon the container content weight detector detecting that the weight increase exceeds a container threshold.

10. The system of claim 9, wherein the controller is further adapted to control the vehicle to return to the position on the path of the mobile sand detection mechanism corresponding to the detected sand accumulation after emptying the container at the peripheral location.

11. The system of claim 1, wherein the sand accumulation locator assembly comprises:

one or more surface condition detectors disposed at respective one or more locations proximate a substantially horizontal surface in the enclosure; and one or more elevated position condition detectors disposed at respective one or more elevated positions in correspondence with the plurality of surface condition detectors, and wherein the controller is further adapted to:

interpret outputs from the one or more surface condition detectors based at least in part upon an output from the one or more elevated position condition detectors to determine the one or more locations of accumulated sand; and control the sand removal mechanism to remove the accumulated sand at the one or more determined locations.

12. The system of claim 11, wherein the one or more surface condition detectors are disposed along a bottom portion of fencing around the enclosure, and the one or more elevated position condition detectors are disposed at respective one or more locations on a top portion of the fencing around the enclosure.

13. The system of claim 11, wherein the sand removal mechanism comprises a plurality of air nozzles disposed proximate locations associated with the one or more surface condition detectors, and the controller is further adapted to toggle at least a subset of the plurality of air nozzles corresponding to the one or more determined locations of accumulated sand.

14. The system of claim 11, wherein the one or more surface condition detectors comprise a plurality of surface temperature detectors, the one or more elevated position condition detectors comprise one or more elevated position temperature detectors, and the controller adapted to interpret the outputs of the one or more surface condition detectors is further adapted to:

compare surface temperatures detected at the plurality of surface temperature detectors with an elevated position temperature detected at the one or more elevated temperature detectors; and determine the one or more locations of accumulated sand by locating one or more of the—surface temperature detectors corresponding to detected surface temperatures that exceed the elevated position temperature by more than a predetermined temperature difference threshold.

15. The system of claim 11, wherein the one or more surface condition detectors comprise one or more surface object distance detectors, the one or more elevated position condition detectors comprise one or more anemometers, and the controller adapted to interpret the outputs of the one or more surface condition detectors is further adapted to:

determine a wind speed based on an output from the one or more anemometers;

when the determined wind speed is below a first threshold, toggle the one or more surface object distance detectors at a first frequency;

when the determined wind speed exceeds the first threshold, toggle the one or more surface object distance detectors at a second frequency higher than the first frequency until the determined wind speed is below a second threshold; and determine the one or more locations of accumulated sand based on detected distances of the toggled one or more surface object distance detectors.

16. The system of claim 15, wherein the sand removal mechanism comprises an array of air nozzles disposed proximate respective locations corresponding to detectable distances of the one or more surface object distance detectors, and the controller is further adapted to toggles at least a subset of the array of air nozzles corresponding to the determined one or more locations of accumulated sand.

17. The system of claim 15, wherein the first frequency is below once per day.

18. The system of claim 15, wherein the second frequency exceeds once per day.

19. The system of claim 15, wherein the first threshold is approximately 25 miles per hour (mph).

20. The system of claim 15, wherein the second threshold is approximately 15.5 miles per hour (mph).

* * * * *